US012600917B2

(12) United States Patent
Nakamura et al.

(10) Patent No.: US 12,600,917 B2
(45) **Date of Patent: *Apr. 14, 2026**

(54) LUBRICATING OIL ADDITIVE COMPOSITION AND LUBRICATING OIL COMPOSITION

(71) Applicant: ENEOS CORPORATION, Tokyo (JP)

(72) Inventors: Toshitaka Nakamura, Tokyo (JP); Shinji Hasegawa, Tokyo (JP); Mayuko Matsuoka, Tokyo (JP)

(73) Assignee: ENEOS CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 18/871,668

(22) PCT Filed: Sep. 11, 2023

(86) PCT No.: PCT/JP2023/033028

§ 371 (c)(1),
(2) Date: Dec. 4, 2024

(87) PCT Pub. No.: WO2024/058114

PCT Pub. Date: Mar. 21, 2024

(65) Prior Publication Data

US 2025/0340795 A1 Nov. 6, 2025

(30) Foreign Application Priority Data

Sep. 16, 2022 (JP) ..... 2022-147725
Sep. 16, 2022 (JP) ..... 2022-147727

(51) Int. Cl.

| | |
|---|---|
| ***C10M 133/16*** | (2006.01) |
| ***C10M 101/00*** | (2006.01) |
| ***C10M 105/06*** | (2006.01) |
| ***C10M 169/04*** | (2006.01) |
| *C10N 10/04* | (2006.01) |
| *C10N 30/02* | (2006.01) |
| *C10N 40/00* | (2006.01) |
| *C10N 40/04* | (2006.01) |
| *C10N 40/25* | (2006.01) |
| *C10N 60/14* | (2006.01) |

(52) U.S. Cl.

CPC ..... *C10M 133/16* (2013.01); *C10M 101/00* (2013.01); *C10M 105/06* (2013.01); *C10M 169/04* (2013.01); *C10M 2203/1025* (2013.01); *C10M 2215/0806* (2013.01); *C10M 2215/082* (2013.01); *C10M 2219/106* (2013.01); *C10M 2229/02* (2013.01); *C10N 2010/04* (2013.01); *C10N 2030/02* (2013.01); *C10N 2040/04* (2013.01); *C10N 2040/25* (2013.01); *C10N 2040/292* (2025.05); *C10N 2060/14* (2013.01)

(58) Field of Classification Search

CPC ..... C10M 133/16; C10M 101/00; C10M 105/06; C10N 2040/04; C10N 2040/292

See application file for complete search history.

(56) References Cited

U.S. PATENT DOCUMENTS

| | | | | |
|---|---|---|---|---|
| 4,208,293 | A * | 6/1980 | Zaweski | C10M 133/16 508/555 |
| 2001/0044389 | A1 | 11/2001 | Komiya et al. | |
| 2003/0195128 | A1 | 10/2003 | Deckman et al. | |
| 2011/0166053 | A1 | 7/2011 | Yamada | |
| 2012/0065109 | A1 | 3/2012 | Matsuoka et al. | |
| 2015/0057202 | A1 | 2/2015 | Nakao et al. | |
| 2016/0251591 | A1* | 9/2016 | DeBlase | C10M 141/06 508/370 |
| 2018/0087002 | A1 | 3/2018 | Komatsubara et al. | |
| 2020/0032160 | A1 | 1/2020 | Komatsubara et al. | |

(Continued)

FOREIGN PATENT DOCUMENTS

| | | | | |
|---|---|---|---|---|
| EP | 2 610 333 | A1 | 7/2013 | |
| EP | 3505608 | A1 * | 7/2019 | C10M 169/04 |
| EP | 3717601 | B1 * | 5/2022 | C10M 133/16 |

(Continued)

OTHER PUBLICATIONS

International Search Report issued in WIPO Patent Application No. PCT/JP2023/033028, dated Nov. 7, 2023, along with an English translation thereof.

(Continued)

*Primary Examiner* — Ellen M McAvoy

(74) *Attorney, Agent, or Firm* — Greenblum & Bernstein, P.L.C.

(57) ABSTRACT

A lubricating oil additive composition including: (i) at least one first amide compound, and/or a salt thereof, the at least one first amide compound being a monoamide of at least one fatty acid (a1), and at least one amine compound (a2), the amine compound (a2) being an oligomer of at least one alkanolamine (a3) represented by the general formula (1); and (ii) at least one second amide compound having a structure such that an amino group and at least one hydroxy group of the alkanolamine (a3) are acylated with the fatty acid (a1):

$$[HO—R^1]_n NH_{3-n} \quad (1)$$

in the formula, n is 1 or 2; $R^1$ is C1-4 linear chain alkylene or C3-10 branched chain alkylene having a main chain, the main chain having a carbon number of 2; and when n is 2, a plurality of $R^1$'s may be the same, and may be different from each other.

13 Claims, No Drawings

(56) References Cited

U.S. PATENT DOCUMENTS

| | | | | |
|---|---|---|---|---|
| 2020/0332207 | A1* | 10/2020 | Yavari | C10L 10/08 |
| 2021/0009920 | A1 | 1/2021 | Kwai | |

FOREIGN PATENT DOCUMENTS

| | | | | |
|---|---|---|---|---|
| JP | 2006-117851 | A | 5/2006 | |
| JP | 2006-257383 | A | 9/2006 | |
| JP | 2009-235252 | A | 10/2009 | |
| JP | 2013-133453 | A | 7/2013 | |
| JP | 2018-53017 | A | 4/2018 | |
| JP | 2018-070700 | A | 5/2018 | |
| WO | 2004/069967 | A1 | 8/2004 | |
| WO | 2010/032781 | A1 | 3/2010 | |
| WO | 2013/136582 | A1 | 9/2013 | |
| WO | 2016/136873 | A1 | 9/2016 | |
| WO | 2018/190431 | A1 | 10/2018 | |
| WO | WO-2019079170 | A1 * | 4/2019 | C10M 141/12 |
| WO | 2019/129793 | A1 | 7/2019 | |

OTHER PUBLICATIONS

International Search Report issued in WIPO Patent Application No. PCT/JP2023/033036, dated Nov. 7, 2023, along with an English translation thereof.

Office Action that issued in U.S. Appl. No. 18/873,118, dated Aug. 25, 2025.

U.S. Appl. No. 18/873,118, filed Dec. 9, 2024, inventors: Toshitaka Nakamura, Fuyuki Aida, Mari Iino, and Shinji Hasegawa (no copy provided per MPEP 609.04(a)(II)(C) and Waiver of the Copy Requirement in 37 CFR 1.98 for Cited Pending U.S. Patent Applications, 1287 OG 163 (Oct. 19, 2004)).

Office Action that issued in U.S. Appl. No. 18/873,118, dated Feb. 19, 2026.

* cited by examiner

LUBRICATING OIL ADDITIVE COMPOSITION AND LUBRICATING OIL COMPOSITION

TECHNICAL FIELD

The present invention relates to lubricating oil additive compositions and lubricating oil compositions, and more specifically, to lubricating oil additive compositions and lubricating oil compositions that can be used suitably for lubrication of gears.

BACKGROUND ART

Lubricating oils are used in internal combustion engines, automatic transmissions, bearings, etc. for smooth operation thereof. Generally, various additives are incorporated in lubricating oils for providing functions required for lubricating oils.

Among lubricating oil additives, additives having frictional resistance lowering effect (friction modifiers, which may be hereinafter referred to as "FM") are important components for cutting an energy loss caused by friction. Generally used FM can be classified into organic molybdenum-based FM that contains molybdenum, and oiliness agent-based FM that improves oiliness thereby reducing friction (also referred to as ashless FM).

As organic molybdenum-based FM, MoDTC (molybdenum dithiocarbamate), and MoDTP (molybdenum dithiophosphate) are widely known (for example, see patent literature 1). These kinds of organic molybdenum-based FM are superior in friction reducing effect in the initial stage of use, but have the limit on keeping this friction reducing effect well for a long term. In addition, since organic molybdenum-based FM has an ash content, it is difficult to reuse used lubricating oils containing organic molybdenum-based FM. Therefore, it is demanded to reduce the adding amount of organic molybdenum-based FM.

In contrast, there is a possibility that oiliness agent-based FM can overcome the above problems on organic molybdenum-based FM. Therefore, the importance of oiliness agent-based FM is increasing (for example, see patent literatures 2 to 4).

CITATION LIST

Patent Literature

[Patent Literature 1] JP 2013-133453 A
[Patent Literature 2] JP 2009-235252 A
[Patent Literature 3] JP 2006-257383 A
[Patent Literature 4] WO 2019/129793 A1

SUMMARY OF INVENTION

Technical Problem

However, conventional oiliness agent-based FM still has room for improvement in friction reducing performance, and solubility in base oil, and in addition, fatigue resistance.

An object of the present invention is to provide a lubricating oil additive composition useful as an oiliness agent-based friction modifier: the friction reducing performance and fatigue resistance improving performance of the lubricating oil additive composition are improved while the solubility thereof in base oil is maintained. A lubricating oil composition comprising this lubricating oil additive composition is also provided.

Solution to Problem

The present invention encompasses the following embodiments [1] to [11].

[1]A lubricating oil additive composition comprising:

(i) at least one first amide compound, and/or a salt thereof, the at least one first amide compound being a monoamide of at least one C6-30 linear or branched chain saturated or unsaturated monovalent fatty acid (a1), and at least one amine compound (a2), the monoamide having no ester bond, the amine compound (a2) being an alkanolamine oligomer having a structure such that at least one alkanolamine (a3) represented by the following general formula (1) is subjected to dehydration condensation, the alkanolamine oligomer having a degree of polymerization of no less than 2; and (ii) at least one second amide compound having a structure such that an amino group and at least one hydroxy group of the at least one alkanolamine (a3) represented by the following general formula (1) are acylated with the monovalent fatty acid (a1), wherein a content of the component (ii) is no less than 8.0 mass % based on total content in terms of entire acylated compound obtained by acylating, with the monovalent fatty acid (a1), a compound having an alkanolamine structure where a hydroxy group may be etherified in a state of forming no salt:

$$[HO—R^1]_n NH_{3-n} \quad (1)$$

in the general formula (1), n is 1 or 2; $R^1$ is C1-4 linear chain alkylene or C3-10 branched chain alkylene having a main chain, the main chain having a carbon number of 2; and when n is 2, a plurality of R's may be the same, and may be different from each other.

[2] The lubricating oil additive composition according to [1], further comprising:

(iii) at least one third amide compound that is an amide of the alkanolamine (a3) and the monovalent fatty acid (a1), the at least one third amide compound having no ester bond.

[3] The lubricating oil additive composition according to [1] or [2], further comprising:

(iv) at least one fourth amide compound, and/or a salt thereof, the at least one fourth amide compound having a structure such that at least one amino group and at least one hydroxy group of the amine compound (a2) are acylated with the monovalent fatty acid (a1).

[4] The lubricating oil additive composition according to any one of [1] to [3], wherein the monovalent fatty acid includes at least one straight chain fatty acid.

[5] The lubricating oil additive composition according to any one of [1] to [4], wherein the monovalent fatty acid includes at least one branched chain fatty acid.

[6] The lubricating oil additive composition according to [5], wherein the branched chain fatty acid has a tertiary or quaternary carbon atom at an α, β or γ position of carbonyl carbon.

[7]A lubricating oil composition comprising:

a lubricant base oil including at least one mineral base oil, at least one synthetic base oil, or combination thereof; and (A) the lubricating oil additive composition according to any one of [1] to [6].

The lubricating oil composition according to [7], wherein a content of the (A) component is 0.005 to 10.0 mass % based on total mass of the lubricating oil composition in terms of entire acylated compound obtained by acylating, with the monovalent fatty acid (a1), a compound having an alkanolamine structure where a hydroxy group may be etherified in a state of forming no salt.

The lubricating oil composition according to [7] or [8], further comprising:

at least one additive selected from a metallic detergent, an ashless dispersant, a phosphorus-containing anti-wear agent, a sulfur-containing extreme-pressure agent, an antioxidant, and a viscosity index improver.

The lubricating oil composition according to any one of [7] to [9], wherein a kinematic viscosity at 40° C. is 5.0 to 50 $mm^2/s$.

[11] The lubricating oil composition according to any one of [7] to [10], wherein the composition is used to lubricate gears.

Advantageous Effects of Invention

The friction reducing performance and fatigue resistance improving performance of the lubricating oil additive composition according to the first aspect of the present invention are improved while the solubility thereof in base oil is maintained, and this lubricating oil additive composition is useful as an oiliness agent-based friction modifier.

The lubricating oil composition according to the second aspect of the present invention comprises the lubricating oil additive composition according to the first aspect of the present invention, whereby the lubricating oil composition can exert improved friction reducing performance and fatigue resistance while the storage stability thereof is maintained.

DESCRIPTION OF EMBODIMENTS

The present invention will be hereinafter described. In the present description, the expression "A to B" concerning the numerical values A and B shall be equivalent to "no less than A and no more than B" unless otherwise specified. In such expression, if a unit is added to the numerical value B only, the same unit shall be applied to the numerical value A. In the present description, the word "or" shall mean a logical sum unless otherwise specified. In the present description, the expression "$E_1$ and/or $E_2$" concerning the elements $E_1$ and $E_2$ is equivalent to "$E_1$, or $E_2$, or the combination thereof", and the expression "$E_1, \ldots,$ and/or $E_N$" concerning n elements $E_1, \ldots, E_i, \ldots, E_N$ (where N is an integer of 3 or more) is equivalent to "$E_1, \ldots,$ or $E_i, \ldots,$ or $E_N$, or any combination thereof" (where i is a variable that can take any integer that satisfies $1<i<N$). In the present description, the "alkaline earth metal" shall encompass magnesium.

In the present description, unless otherwise specified, the content of each of the elements of calcium, magnesium, zinc, phosphorus, sulfur, boron, barium, and molybdenum in oil shall be measured conforming to JIS K0116 by inductively coupled plasma atomic emission spectrometry (intensity ratio method (internal standard method)). In addition, the content of a nitrogen element in oil shall be measured conforming to JIS K2609 by a chemiluminescence method. In the present description, the "weight average molecular weight" means the weight average molecular weight measured by gel permeation chromatography (GPC) in terms of standard polystyrene. The measurement conditions for GPC are as follows.

[GPC Measurement Conditions]

device: ACQUITY (registered trademark) APC UV RI System, manufactured by Waters Corporation column: two columns of ACQUITY (registered trademark) APC XT900A manufactured by Waters Corporation (gel particle size: 2.5 μm, column size (inner diameter×length): 4.6 mm×150 mm), and one column of ACQUITY (registered trademark) APC XT200A manufactured by Waters Corporation (gel particle size: 2.5 μm, column size (inner diameter×length): 4.6 mm×150 mm) are connected in series in this order from the upstream side column temperature: 40° C.

sample solution: tetrahydrofuran solution having a sample concentration of 1.0 mass % eluent: tetrahydrofuran solution injection volume: 20.0 μL detector: differential refractometer standard material: standard polystyrene (Agilent EasiCal (registered trademark) PS-1 manufactured by Agilent Technologies, Inc.), eight points (molecular weight: 2698000, 597500, 290300, 133500, 70500, 30230, 9590 and 2970)

If the weight average molecular weight measured under the foregoing conditions is less than 10000, the columns and the standard material are changed according to the following conditions, and the weight average molecular weight is measured again.

column: one column of ACQUITY (registered trademark) APC XT125A manufactured by Waters Corporation (gel particle size: 2.5 μm, column size (inner diameter×length): 4.6 mm×150 mm), and two columns of ACQUITY (registered trademark) APC XT45A manufactured by Waters Corporation (gel particle size: 1.7 μm, column size (inner diameter×length): 4.6 mm×150 mm) are connected in series in this order from the upstream side standard material: standard polystyrene (Agilent EasiCal (registered trademark) PS-1 manufactured by Agilent Technologies, Inc.), 10 points (molecular weight: 30230, 9590, 2970, 890, 786, 682, 578, 474, 370 and 266)

<1. Lubricating Oil Additive Composition>

A lubricating oil additive composition according to the first aspect of the present invention (hereinafter may be simply referred to as the "additive composition") comprises: (i) at least one first amide compound, and/or a salt thereof, the at least one first amide compound being a monoamide of at least one C6-30 linear or branched chain saturated or unsaturated monovalent fatty acid (a1), and at least one amine compound (a2), the monoamide having no ester bond, the amine compound (a2) being an alkanolamine oligomer having a structure such that at least one alkanolamine (a3) represented by the following general formula (1) is subjected to dehydration condensation, the alkanolamine oligomer having a degree of polymerization of no less than 2 (hereinafter may be referred to as the "(i) component"); and (ii) at least one second amide compound having a structure such that an amino group and at least one hydroxy group of the at least one alkanolamine (a3) represented by the following general formula (1) are acylated with the monovalent fatty acid (a1) (hereinafter may be referred to as the "(ii)

component"), wherein a content of the component (ii) is no less than 20 mass % on the basis of the total content in terms of entire acylated compound obtained by acylating, with the monovalent fatty acid (a1), a compound having an alkanolamine structure where a hydroxy group may be etherified in a state of forming no salt:

$$[HO-R^1]_n NH_{3-n} \quad (1)$$

(in the general formula (1), n is 1 or 2; $R^1$ is C1-4 linear chain alkylene or C3-10 branched chain alkylene having a main chain having a carbon number of 2; and when n is 2, a plurality of $R^1$'s may be the same, and may be different from each other).

The fatty acid (a1) may be one fatty acid, and may be any combination of at least two fatty acids. The fatty acid (a1) may be a saturated fatty acid, and may be an unsaturated fatty acid. The fatty acid (a1) may be a straight chain fatty acid, and may be a branched chain fatty acid. In one preferred embodiment, the fatty acid (a1) can be a branched chain fatty acid. Examples of a straight chain saturated fatty acid as used herein include hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, eicosanoic acid, heneicosanoic acid, docosanoic acid, tetracosanoic acid, hexacosanoic acid, octacosanoic acid, and triacontanoic acid; and examples of a branched chain saturated fatty acid as used herein include branched chain isomers thereof. Examples of a straight chain unsaturated fatty acid as used herein include hexenoic acid, heptenoic acid, octenoic acid, nonenoic acid, decenoic acid, undecenoic acid, dodecenoic acid, tridecenoic acid, tetradecenoic acid, pentadecenoic acid, hexadecenoic acid, heptadecenoic acid, octadecenoic acid, nonadecenoic acid, eicosenoic acid, heneicosenoic acid, docosenoic acid, tetracosenoic acid, hexacosenoic acid, octacosenoic acid, and triacontenoic acid; and examples of a branched chain unsaturated fatty acid as used herein include branched chain isomers thereof. In the unsaturated fatty acid, the position of the C=C double bond is not particularly limited. The number of the C=C double bonds in the unsaturated fatty acid may be one (i.e., monoenoic acid), may be two (i.e., dienoic acid), may be three (i.e., trienoic acid), and may be four (i.e., tetraenoic acid) or more. The C=C double bond in the unsaturated fatty acid may be in the cis-form (Z-form), and may be in the trans-form (E-form). The C=C double bond in the cis-form (Z-form), and the C=C double bond in the trans-form (E-form) may coexist in different molecules or the same molecule. For example, a fatty acid derived from hydrogenated natural fat and oil can include, in addition to a saturated fatty acid generated by the hydrogenation, an unsaturated fatty acid having the C=C double bond in the cis-form, and an unsaturated fatty acid having the C=C double bond in the trans-form that are derived from the side-reaction of the hydrogenation reaction. For example, specific examples of a C18 unsaturated fatty acid as used herein include various analogous compounds having different numbers and/or positions of C=C double bonds, and/or different geometric isomerisms, such as oleic acid (cis-9-octadecenoic acid), vaccenic acid (11-octadecenoic acid), linoleic acid (cis,cis-9,12-octadecadienoic acid), linolenic acid (9,12,15-octadecanetrienoic acid, 6,9,12-octadecanetrienoic acid), and eleostearic acid (9,11,13-octadecanetrienoic acid). Examples of an unsaturated fatty acid having other carbon numbers as used herein also include various analogous compounds having different numbers and/or positions of C=C double bonds, and/or different geometric isomerisms.

The carbon number of the fatty acid (a1) is no less than 6, and preferably no less than 8, or no less than 10, or no less than 12 in view of enhancing friction reducing effect in lubrication of gears etc.; is no more than 30, preferably no more than 24, or no more than 22, or no more than 20, or no more than 18 in the same view; and in one embodiment, can be 6 to 30, or 8 to 24, or 8 to 22, or 10 to 22, or 12 to 20, or 12 to 18. In one embodiment, the fatty acid (a1) can be at least one straight chain fatty acid. Preferred examples of a straight chain fatty acid as used herein include caproic acid, enanthic acid, caprylic acid, pelargonic acid, capric acid, lauric acid, myristic acid, myristoleic acid, palmitic acid, palmitoleic acid, stearic acid, oleic acid, vaccenic acid, elaidic acid, linoleic acid, linolenic acid, eleostearic acid, stearidonic acid, arachidic acid, gadoleic acid, eicosenoic acid, eicosapentaenoic acid, behenic acid, erucic acid, clupanodonic acid, docosahexaenoic acid, lignoceric acid, nisinic acid, nervonic acid, cerotic acid, montanic acid, and melissic acid, and mixtures thereof. As a mixture including at least two fatty acids, fatty acids derived from natural fat and oil, or hydrogenated natural fat and oil may be used. Examples of fatty acids derived from natural fat and oil as used herein include coconut oil fatty acids, palm kernel oil fatty acids, palm oil fatty acids, tung oil fatty acids, tall oil fatty acids, corn oil fatty acids, rapeseed oil fatty acids, olive oil fatty acids, sesame oil fatty acids, soybean oil fatty acids, rice bran oil fatty acids, sunflower oil fatty acids, castor oil fatty acids, linseed oil fatty acids, fish oil fatty acids, beef tallow fatty acids, hydrogen adducts thereof, and mixtures thereof. These fatty acids derived from natural fat and oil usually constitute a mixture including at least two C6-24 fatty acids. In one embodiment, the fatty acid (a1) can be at least one branched chain fatty acid. In one embodiment, the branched chain fatty acid preferably has a tertiary or quaternary carbon atom (i.e., branch) at the α, β or γ position of carbonyl carbon, preferably has a tertiary or quaternary carbon atom at the α or β position of carbonyl carbon, and particularly preferably has a tertiary or quaternary carbon atom at the α position of carbonyl carbon. One preferred example of such a branched chain fatty acid is the branched chain fatty acid represented by the following general formula (2):

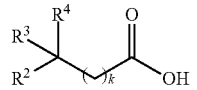

(2)

(in the general formula (2), k is an integer of 0 to 2, preferably 0 or 1, and more preferably 0; $R^2$ and $R^3$ are each independently a linear or branched chain alkyl group; $R^4$ is a hydrogen atom, or a linear or branched chain alkyl group, preferably a hydrogen atom; (carbon number of $R^2$)≥(carbon number of $R^3$)≥(carbon number of $R^4$); and (carbon number of $R^2$)+(carbon number of $R^3$)+(carbon number of $R^4$)+k+2 is equal to the total carbon number of this branched chain fatty acid).

In one preferred embodiment, in the general formula (2), k can be 0, $R^2$ can be C3-19 linear or branched chain alkyl, $R^3$ can be C1-10 linear or branched chain alkyl, and $R^4$ can be a hydrogen atom. Preferred examples of the branched chain fatty acid represented by the general formula (2) include 2-ethylhexanoic acid, 2-butyloctanoic acid, 2-decyltetradecanoic acid, and 5,7,7-trimethyl-2-(1,3,3-trimethylbutyl)octanoic acid. If necessary, for example, such a branched chain fatty acid can be produced by: synthesizing an aldehyde and/or alcohol by the reaction of carbon dioxide with an organometallic compound prepared from a secondary or tertiary alkyl halide, such as a Grignard reagent and an alkyllithium, or by the reaction of an alkene, carbon monoxide, and hydrogen in the presence of a hydroformylation catalyst; and subjecting the obtained aldehyde and/or alcohol to a further oxidative reaction. If necessary, for example, a secondary or tertiary alkyl halide as used herein can be produced by the addition reaction of a corresponding alkene with halogenated hydrogen (such as hydrogen chloride, hydrogen bromide, and hydrogen iodide). Usually, a secondary or tertiary alkyl halide derived from an alkene is obtained as a mixture of secondary or tertiary alkyl halide isomers between which halogen atoms are bonded to different positions. Usually, a branched chain fatty acid derived from such a mixture of secondary or tertiary alkyl halide isomers is obtained as a mixture of branched chain fatty acid isomers between which the combinations of the carbon numbers of $R^2$ to $R^4$ in the general formula (2) are different. Other preferred examples of such a branched chain fatty acid include branched chain fatty acids each having a methyl branch at an end thereof. A preferred example of such a branched chain fatty acid is the branched chain fatty acid represented by the following general formula (3):

(3)

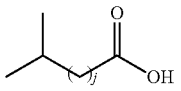

(in the general formula (3), j+4 is equal to the total carbon number of the branched chain fatty acid).

A preferred example of such a branched chain fatty acid is 16-methylheptadecanoic acid.

The amine compound (a2) is an alkanolamine oligomer having the structure such that the at least one alkanolamine (a3) represented by the following general formula (1) is subjected to dehydration condensation, and having a degree of polymerization of no less than 2.

(1)

$$[HO-R^1]_n NH_{3-n}$$

(in the general formula (1), n is 1 or 2; $R^1$ represents CT-4 linear chain alkylene or C3-10 branched chain alkylene having a main chain having a carbon number of 2; and when n is 2, a plurality of $R^1$'s may be the same, and may be different from each other.)

In the general formula (1), $R^1$ is CT-4 linear chain alkylene or C3-10 branched chain alkylene having a main chain having a carbon number of 2. The carbon number of $R^1$, which is a linear chain alkylene group, is preferably 2 to 4, or 2 to 3, and in one embodiment, can be 2. In one embodiment, each side chain of $R^1$, which is a branched chain alkylene group, can be a methyl group or an ethyl group, and the carbon number of $R^1$ can be 3 to 6, or 3 to 5, or 3 to 4. In this description, the carbon number of the main chain of $R^1$ means the carbon number of the shortest carbon chain that connects the nitrogen atom and the oxygen atom, which are bonded to $R^1$, and is fixed irrespective of selection of the main chain used for naming $R^1$. For example, when $R^1$ is a butane-1,2-diyl group, the carbon number of the main chain of $R^1$ is 2. When $R^1$ is a linear chain alkylene group, the carbon number of the main chain of $R^1$ is equal to the carbon number of $R^1$. When $R^1$ is a branched chain alkylene group, each side chain of $R^1$ is preferably a methyl group or ethyl group, and in one embodiment, can be a methyl group. For example, an alkanolamine having $R^1$ which is C2 linear chain alkylene can be produced by the reaction of an unsubstituted oxirane with ammonia. For example, an alkanolamine having $R^1$ which is C3 linear chain alkylene can be produced by the reaction of an unsubstituted oxetane with ammonia. For example, an alkanolamine having $R^1$ which is C4 linear chain alkylene can be produced by the reaction of unsubstituted tetrahydrofuran with ammonia. For example, an alkanolamine having $R^1$ which is a branched chain alkylene group having a main chain having a carbon number of 2 can be produced by the reaction of a substituted oxirane with ammonia; at this time, the substituents of the substituted oxirane are the respective side chains of $R^1$, which is a branched chain alkylene group. Preferred examples of $R^1$ when $R^1$ is an alkylene group include linear chain alkylene groups such as an ethane-1,2-diyl group, and a propane-1,3-diyl group; a propane-1,2-diyl group; C4 branched chain alkylene such as a butane-1,2-diyl group, a butane-2,3-diyl group, and a 1-methylpropane-1,2-diyl group; C5 branched chain alkylene such as a pentane-1,2-diyl group, a pentane-2,3-diyl group, a 2-methylbutane-1,2-diyl group, and a 3-methylbutane-2,3-diyl group; C6 branched chain alkylene such as a hexane-1,2-diyl group, a hexane-2,3-diyl group, a hexane-3,4-diyl group, a 2-methylpentane-2,3-diyl group, a 3-methylpentane-2,3-diyl group, and a 2,3-dimethylbutane-2,3-diyl group; C7 branched chain alkylene such as a heptane-1,2-diyl group, a heptane-2,3-diyl group, a heptane-3,4-diyl group, a 3-ethylpentane-2,3-diyl group, and a 3-methylpentane-3,4-diyl group; C8 branched chain alkylene such as an octane-1,2-diyl group, an octane-2,3-diyl group, an octane-3,4-diyl group, an octane-4,5-diyl group, a 3-ethylhexane-3,4-diyl group, a 3-ethyl-2-methylpentane-2,3-diyl group, and a 3,4-dimethylhexane-3,4-diyl group; C9 branched chain alkylene such as a nonane-1,2-diyl group, a nonane-2,3-diyl group, a nonane-3,4-diyl group, a nonane-4,5-diyl group, and a 2,3-diethylpentane-2,2-diyl group; and C10 branched chain alkylene such as a decane-1,2-diyl group, a decane-2,3-diyl group, a decane-3,4-diyl group, a decane-4,5-diyl group, a decane-5,6-diyl group, and a 3,4-diethylhexane-3,4-diyl group. $R^1$ may be a single alkylene group, and may be any combination of at least two alkylene groups.

In one preferred embodiment, when being an alkylene group, $R^1$ can be an ethane-1,2-diyl group, a propane-1,3-diyl group, a propane-1,2-diyl group, a butane-1,2-diyl group, a butane-1,4-diyl group, or a butane-2,3-diyl group, or any combination thereof.

The alkanolamine represented by the general formula (1) is a monoalkanolamine when n=1, and is a dialkanolamine when n=2. When $R^1$ is an unsymmetrical branched chain alkylene group, that is, an alkylene group having different side chains bonded to two remaining valences (such as a propane-1,2-diyl group, a butane-2,3-diyl group, and a pentane-2,3-diyl group), either one of the two remaining valences may be bonded to the nitrogen atom. For example, in the reaction of propylene oxide with ammonia, the reaction pathway via which the propanolamine structure such that the 1-position of a propylene-1,2-diyl group is bonded to the nitrogen atom (that is, a 2-hydroxypropyl group is bonded to the nitrogen atom) is given, and the reaction pathway via which the propanolamine structure such that the 2-position of a propylene-1,2-diyl group is bonded to the nitrogen atom (that is, a 1-hydroxypropane-2-yl group is bonded to the nitrogen atom) is given compete with each other, and a mixture of products via both the pathways can be given. In the dialkanolamine represented by the general formula (1) where n=2, two $R^1$'s may be the same, and may be different from each other. When two $R^1$'s are the same unsymmetrical branched chain alkylene groups, the directions of two $R^1$'s may be the same, and may be different from each other. For example, in a dipropanolamine where two $R^1$'s are propane-1,2-diyl groups, two HO—$R^1$— groups may be both 2-hydroxy propyl groups, may be both 1-hydroxypropane-2-yl groups, and may be a 2-hydroxypropyl group and a 1-hydroxypropane-2-yl group. When a dipropanolamine is produced by the reaction of propylene oxide with ammonia, compounds thereof can be also generated at the same time, and a mixture thereof can be given. The at least one alkanolamine (a3) represented by the general formula (1) may be at least one monoalkanolamine, may be at least one dialkanolamine, may be any combination of at least one monoalkanolamine and at least one dialkanolamine, and is particularly preferably at least one dialkanolamine.

In the component (i), the amine compound (a2) forming the monoamide along with the monovalent fatty acid (a1) is the alkanolamine oligomer having the structure such that the at least one alkanolamine (a3) represented by the general formula (1) is subjected to dehydration condensation, and having a degree of polymerization of no less than 2. For example, the following general formula (4) represents the reaction of generating an alkanolamine dimer having a degree of polymerization of 2 (a2-dd) by the dehydration condensation reaction of two molecules of a dialkanolamine (a3d). For example, the following general formula (5) represents the reaction of generating an alkanolamine dimer having a degree of polymerization of 2 (a2-mm) by the dehydration condensation reaction of two molecules of a monoalkanolamine (a3m). For example, the following general formula (6) represents the reaction of generating an alkanolamine dimer having a degree of polymerization of 2 (a2-dm or a2-md) by the dehydration condensation reaction of one molecule of the dialkanolamine (a3d) and one molecule of the monoalkanolamine (a3m). As shown in the general formula (6), in the dehydration condensation reaction of a dialkanolamine and a monoalkanolamine, the resultant product can include a structural isomer. Which structural isomer is generated depends on which hydroxy group in the molecules is eliminated.

(4)

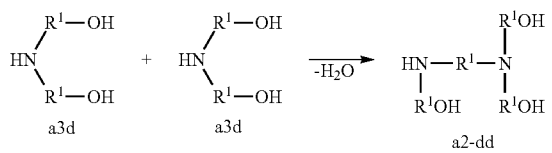

(5)

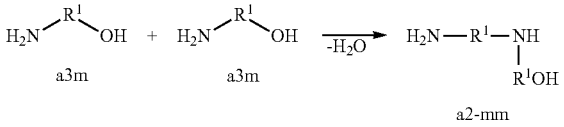

-continued (6)

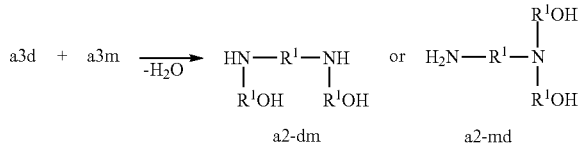

As shown in the general formulae (4) to (6), in the dehydration condensation on the alkanolamine (a3), a hydroxy group is eliminated from one molecule, and a new C—N bond is generated between the carbon atom (a carbon in the hydroxy group) to which the eliminated hydroxy group was bonded, and the nitrogen atom of the primary or secondary amine of the other molecule. For example, the following general formula (7) represents the reaction of generating an alkanolamine trimer having a degree of polymerization of 3 (a2-ddd1 or a2-ddd2) by the dehydration condensation on three molecules of the dialkanolamine.

(7)

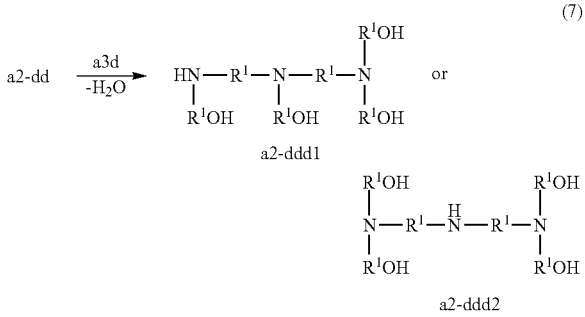

In the general formula (7), for the generation of the dimer (a2-dd), the general formula (4) is referred to. As shown in the general formula (7), the dialkanolamine trimer may include structural isomers (a2-ddd1 and a2-ddd2) correspondingly to the hydroxy group eliminated from the dialkanolamine dimer (a2-dd). In the same manner, an alkanolamine oligomer having a degree of polymerization of no less than 4 can also include a plurality of structural isomers. For example, the following general formula (8) represents the reaction of generating an alkanolamine trimer having a degree of polymerization of 3 (a2-mmm1 or a2-mmm2) by the dehydration condensation on three molecules of the monoalkanolamine.

(8)

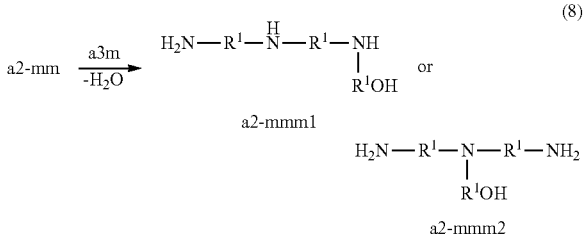

In the general formula (8), for the generation of the dimer (a2-mm), the general formula (5) is referred to. As shown in the general formula (8), the monoalkanolamine trimer may include structural isomers (a2-mmm1 and a2-mmm2) correspondingly to the hydroxy group eliminated from the monoalkanolamine dimer (a2-mm). In the same manner, an alkanolamine oligomer having a degree of polymerization of no less than 4 can also include a plurality of structural isomers. For example, the following general formulae (9a) to (9c) each represent the reaction of generating a mixed alkanolamine trimer having a degree of polymerization of 3 (a2-ddm1, a2-ddm2, a2-dmd, or a2-mdd) by the dehydration condensation on two molecules of the dialkanolamine and one molecule of the monoalkanolamine (9a)

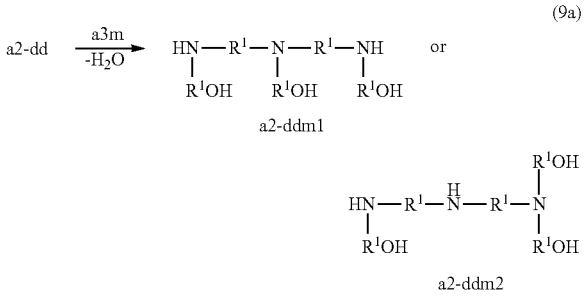

(9b)

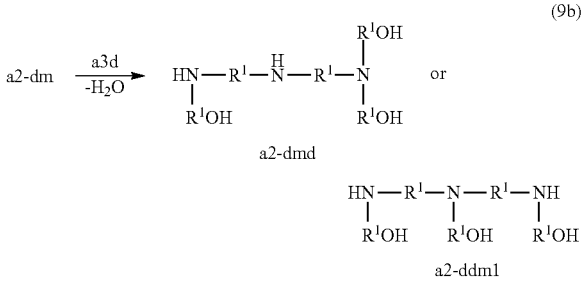

(9c)

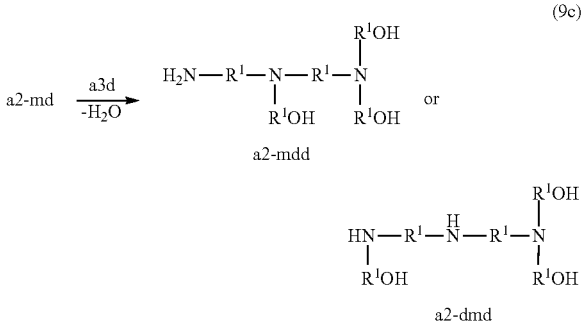

In the general formulae (9a) to (9c), for the generation of the dimers (a2-dd, a2-dm, and a2-md), the general formulae (4) and (6) are referred to. As shown in the general formulae (9a) to (9c), the mixed alkanolamine trimer can include structural isomers (a2-ddm1, a2-ddm2, a2-dmd, and a2-mdd) correspondingly to the eliminated hydroxy groups. In the same manner, a mixed alkanolamine oligomer having a degree of polymerization of no less than 4 can also include a plurality of structural isomers. For example, the following general formulae (10a) to (10c) each represent the reaction of generating a mixed alkanolamine trimer having a degree of polymerization of 3 (a2-mmd, a2-dmm1, or a2-dmm2) by the dehydration condensation on one molecule of the dialkanolamine, and two molecules of the monoalkanolamine.

(10a)

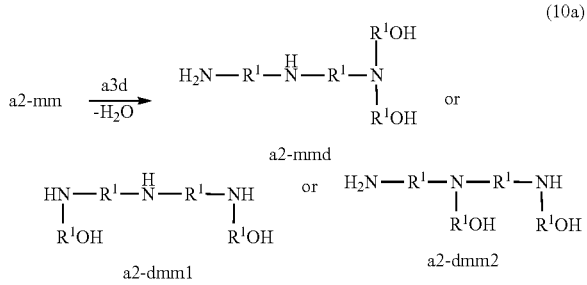

(10b)

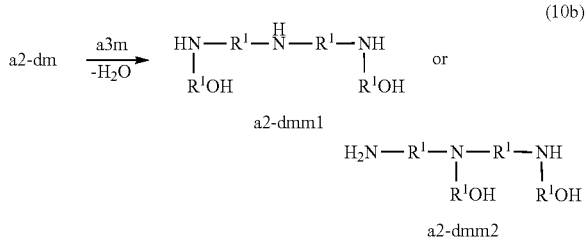

(10c)

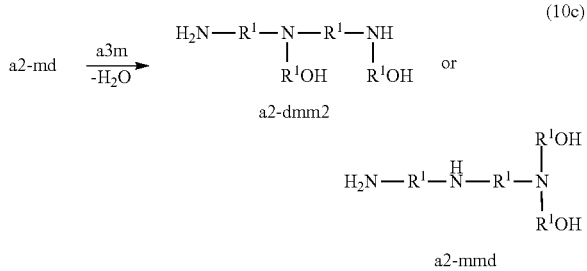

In the general formulae (10a) to (10c), for the generation of the dimers (a2-mm, a2-dm, and a2-md), the general formulae (5) and (6) are referred to. As shown in the general formulae (10a) to (10c), the mixed alkanolamine trimer can include structural isomers (a2-mmd, a2-dmm1, and a2-dmm2) correspondingly to the eliminated hydroxy groups. In the same manner, a mixed alkanolamine oligomer having a degree of polymerization of no less than 4 can also include a plurality of structural isomers. As described, when the degree of polymerization of the alkanolamine oligomer having the structure such that the at least one alkanolamine (a3) represented by the general formula (1) is subjected to dehydration condensation is 2 or 3, this alkanolamine oligomer can be represented by the following general formula (11):

(11)

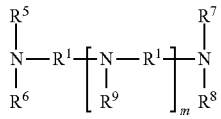

(in the general formula (11), $R^5$ to $R^9$ each independently represent a hydrogen atom, or a —$R^1$—OH group; $R^1$'s are as defined in the above; a plurality of $R^1$'s may be the same, and may be different from each other; m is 0 or 1; when m is 0, at least one of $R^5$ to $R^8$ is a hydrogen atom, and at least another one of $R^5$ to $R^8$ is a —$R^1$—OH group; and when m is 1, at least one of $R^5$ to $R^9$ is a hydrogen atom, and at least another one of $R^5$ to $R^9$ is a —$R^1$—OH group).

In one embodiment, in the general formula (11), when m is 0, one of $R^5$ to $R^8$ can be a hydrogen atom, and the other three thereof can be —$R^1$—OH groups. In addition, when m is 1, one of $R^5$ to $R^9$ can be a hydrogen atom, and the other four can be —$R^1$—OH groups.

When the degree of polymerization of the alkanolamine oligomer having the structure such that the at least one alkanolamine (a3) represented by the general formula (1) is subjected to dehydration condensation is no less than 4, this alkanolamine oligomer includes an isomer having a linear chain polyalkylene amine skeleton, and an isomer having a branched chain polyalkyleneamine skeleton.

For example, when the degree of polymerization of this alkanolamine oligomer is 4, an isomer thereof that has a linear chain polyalkyleneamine skeleton is the compound obtained by substituting —$R^1$—OH groups for a part of the hydrogen atoms bonded to the N atoms of the unsubstituted linear chain polyalkyleneamine represented by the following general formula (12a); an isomer thereof that has a branched chain polyalkyleneamine skeleton is the compound obtained by substituting —$R^1$—OH groups for a part of the hydrogen atoms bonded to the N atoms of the unsubstituted branched chain polyalkyleneamine represented by the following general formula (12b); and $R^1$'s are as defined in the above, and a plurality of $R^1$'s may be the same, and may be different from each other.

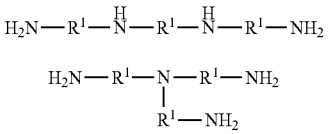

(12a)

(12b)

In this description, that an unsubstituted polyalkyleneamine having m+2 (m≥1) N atoms is a "linear chain" means this unsubstituted polyalkyleneamine has two primary amino groups and m secondary amino groups, and is determined irrespective of whether the alkylene group is a linear or branched chain. In contrast, that an unsubstituted polyalkyleneamine is a "branched chain" means this unsubstituted polyalkyleneamine has at least one tertiary amino group, and is determined irrespective of whether the alkylene group is a linear or branched chain. When having k (1≤k≤m/2) tertiary amino groups, an unsubstituted branched chain poly alkyleneamine having m+2 (m≥2) N atoms has 2+k primary amino groups, and m−2k secondary amino groups. Generally, when the degree of polymerization of the aforementioned alkanolamine oligomer m+2 is no less than 4, an isomer thereof that has a linear chain polyalkyleneamine skeleton is the compound obtained by substituting —$R^1$—OH groups for a part (for example, m+3) of the hydrogen atoms bonded to the N atoms of the unsubstituted linear chain polyalkyleneamine represented by the following general formula (13); an isomer thereof that has a branched chain polyalkyleneamine skeleton is the compound obtained by substituting —$R^1$—OH groups for a part (for example, m+3) of the hydrogen atoms bonded to the N atoms of an unsubstituted branched chain poly alkyleneamine isomer of the unsubstituted linear chain polyalkyleneamine represented by the following general formula (13); and $R^1$'s are as defined in the above, and a plurality of $R^1$'s may be the same, and may be different from each other.

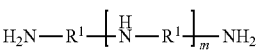

(13)

(in the general formula (13), m≥2 correspondingly to the degree of polymerization of the alkanolamine oligomer m+2.)

The degree of polymerization of the amine compound (a2), that is, the alkanolamine oligomer is no less than 2, is preferably 2 to 15, or 2 to 10, and in one embodiment, can be 2 to 4, or 2 to 3. The alkanolamine oligomer (a2) may have a single degree of polymerization, and may be any combination of oligomers having a plurality of different degrees of polymerization. In one embodiment, the alkanolamine oligomer (a2) can be any combination of oligomers having a plurality of different consecutive degrees of polymerization. In this description, that an oligomer is a "combination of oligomers having a plurality of different consecutive degrees of polymerization" means the oligomer includes oligomers of all the degrees of polymerization of $d_{min}$ to $d_{MAX}$ when the minimum and maximum values of the degrees of polymerization of the oligomer is defined as $d_{min}$ and $d_{MAX}$, respectively.

The first amide compound is the monoamide of the at least one monovalent fatty acid (a1) and the at least one amine compound (a2), and has no ester bond. The component (i) is this first amide compound, and/or a salt thereof. The first amide compound has at least one nitrogen atom of amines which are not acylated, and thus, can form an acid and a salt. The salt of the first amide compound may be a salt of the first amide compound and an organic acid (organic acid salt), may be a salt of the first amide compound and an inorganic acid (inorganic acid salt), and may any combination of at least one organic acid salt and at least one inorganic acid salt. An organic acid salt here may be one organic acid salt, and may be any combination of at least two organic acid salts. An inorganic acid salt here may be one inorganic acid salt, and may be any combination of at least two inorganic acid salts. As described later, an organic acid to constitute an organic acid salt here may be the monovalent fatty acid (a1).

Examples of an inorganic acid to constitute an inorganic acid salt along with the first amide compound include inorganic Broensted acids such as: halogenated hydrogen including hydrogen fluoride, hydrogen chloride, hydrogen bromide, and hydrogen iodide; inorganic oxoacids including oxyhalogen acids, for example, hypochlorous acid, chlorous acid, chloric acid, perchloric acid, hypobromous acid, bromous acid, bromic acid, perbromic acid, hypoiodous acid, iodous acid, iodic acid, and periodic acid, nitric acid, nitrous acid, sulfuric acid, sulfurous acid, phosphoric acid (which means an oxoacid of phosphorus that has a phosphorus atom having a formal oxidation number of +V, may be orthophosphoric acid, and may be condensed phosphoric acids such as pyrophosphoric acid and polyphosphoric acid), phosphorous acid, boric acid (which means an oxoacid of boron that has a boron atom having a formal oxidation number of +III, may be orthoboric acid, and may be condensed boric acid such as tetraboric acid, and metaboric acid), and carbonic acid; and hydrocyanic acid.

Examples of an organic acid to constitute an organic acid salt here along with the first amide compound include organic Broensted acids such as carboxylic acids, organic sulfonic acids, organic phosphonic acids and monoesters thereof, organic boronic acids and monoesters thereof, sulfate monoesters, phosphate monoesters, phosphate diesters, phosphite monoesters, phosphite diesters, boronate monoesters, boronate diesters, and substituted or unsubstituted phenols.

Examples of a carboxylic acid to constitute a salt along with the first amide compound include aliphatic carboxylic acids, and aromatic carboxylic acids.

Examples of an aliphatic carboxylic acid as used herein include C1-5 monovalent fatty acids, C6-30 monovalent fatty acids, C2-10 divalent aliphatic dicarboxylic acids and monoesters thereof, and aliphatic hydroxy acids.

Examples of a C1-5 monovalent fatty acid as used herein include formic acid, acetic acid, propionic acid, butyric acid, and valeric acid. The carbon number of a C1-5 monovalent fatty acid as used herein is preferably 2 to 5.

Examples of a C6-30 monovalent fatty acid as used herein include various monovalent fatty acids described above in relation to the monovalent fatty acid (a1).

Examples of a C2-10 divalent aliphatic dicarboxylic acid as used herein include oxalic acid, malonic acid, succinic acid, fumaric acid, maleic acid, glutaric acid, adipic acid, pimelic acid, suberic acid, azelaic acid, and sebacic acid; and an example of a monoester thereof is a monoester of this divalent aliphatic dicarboxylic acid, and an alcohol such as methanol, ethanol, propanol, isopropyl alcohol, butanol, pentanol, hexanol, heptanol, octanol, 2-ethylhexanol, nonanol, decanol, undecanol, and dodecanol, for example, a C1-12, or C1-10, or C1-8 alkyl alcohol.

Examples of an aliphatic hydroxy acid as used herein include C2-18 aliphatic hydroxy acids such as glycolic acid, lactic acid, tartronic acid, glyceric acid, hydroxybutyric acid, malic acid, tartaric acid, citramalic acid, citric acid, isocitric acid, leucic acid, mevalonic acid, pantoic acid, ricinoleic acid, ricinelaidic acid, quinic acid, and shikimic acid.

Other examples of an aliphatic carboxylic acid as used herein include halogenated (for example, fluorinated) aliphatic carboxylic acids such as trifluoroacetic acid, 3,3,3-trifluoropropionic acid, and 4,4,4-trifluorobutyric acid.

Examples of an aromatic carboxylic acid as used herein include aromatic monocarboxylic acids, aromatic dicarboxylic acids and monoesters thereof, aromatic hydroxy acids, and aromatic polycarboxylic acids.

Examples of an aromatic monocarboxylic acid as used herein include C7-10 compounds such as benzoic acid, o- or m- or p-toluic acid, phenylacetic acid, and cinnamic acid.

Examples of an aromatic dicarboxylic acid as used herein include phthalic acid, isophthalic acid, and terephthalic acid; and an example of a monoester thereof is a monoester of this aromatic dicarboxylic acid, and any of various alcohols described above in relation to a monoester of divalent aliphatic dicarboxylic acids.

Examples of an aromatic hydroxy acid as used herein include C7-14 compounds such as salicylic acid, (m- or p-) hydroxy benzoic acid, (o-, m- or p-) hydroxymethyl benzoic acid, vanillic acid, syringic acid, (2,3-, 2,4-2,5-, 2,6-, 3,4- or 3,5-) dihydroxy benzoic acid, orselic acid, gallic acid, mandelic acid, hydroxy diphenylacetic acid (benzilic acid), atrolactic acid, phloretic acid, (o-, m- or p-) hydroxy cinnamic acid, (2,3-, 2,4-, 2,5-, 2,6-, 3,4- or 3,5-) dihydroxycinnamic acid, ferulic acid, and sinapic acid.

Examples of an aromatic polycarboxylic acid as used herein include compounds each having the structure obtained by substituting carboxy groups for three to six hydrogen atoms of benzene, such as trimellitic acid and mellitic acid.

An example of an organic sulfonic acid as used herein include the compound represented by the following general formula (14):

(14)

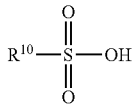

(in the general formula (14), $R^{10}$ represents an organic group having a carbon number of no less than 1, for example, 1 to 18).

Examples of $R^{10}$ include C1-18 linear or branched chain alkyl or alkenyl such as a methyl group, an ethyl group, a propyl group, an isopropyl group, a butyl group, a pentyl group, a hexyl group, a heptyl group, an octyl group, a 2-ethylhexyl group, a nonyl group, a decyl group, an undecyl group, a dodecyl group, a tridecyl group, a tetradecyl group, a pentadecyl group, a hexadecyl group, a heptadecyl group, an octadecyl group, and an oleyl group; C6-10 aromatic hydrocarbon such as a phenyl group, a tolyl group, a xylyl group, a mesityl group, a cumyl group, and a naphthyl group; halogenated hydrocarbon groups such as a trifluoromethyl group, a 2,2,2-trifluoroethyl group, a fluorophenyl group, a chlorophenyl group, a dichlorophenyl group, and a trichlorophenyl group; and a camphor-10-yl group. Preferred examples of an organic sulfonic acid as used herein include C1-10 compounds such as methanesulfonic acid, trifluoromethanesulfonic acid, benzenesulfonic acid, p-toluenesulfonic acid, and 10-camphorsulfonic acid.

An example of an organic phosphonic acid as used herein is the compound represented by the following general formula (15):

(15)

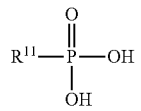

(in the general formula (15), $R^{11}$ represents an organic group having a carbon number of no less than 1, for example, 1 to 18).

Examples of $R^{11}$ include C1-18 linear or branched chain alkyl or alkenyl and C6-10 aromatic hydrocarbon which are described above in relation to $R^{10}$.

An example of a monoester of an organic phosphonic acid as used herein is a monoester of this organic phosphonic acid, and any of various alcohols described above in relation to a monoester of the divalent aliphatic dicarboxylic acid.

An example of an organic boronic acid as used herein is the compound represented by the following general formula (16):

(16)

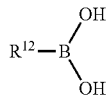

(in the general formula (16), $R^{12}$ represents an organic group having a carbon number of no less than 1, for example, 1 to 18).

Examples of $R^{12}$ include C1-18 linear or branched chain alkyl or alkenyl and C6-10 aromatic hydrocarbon which are described above in relation to $R^{10}$. Other examples of $R^{12}$ include C5-6 cycloalkyl such as a cyclopentyl group, and a cyclohexyl group; arylalkyl groups such as a phenethyl group; (for example, C6-7) halogenated aromatic hydrocarbons such as a fluorophenyl group, a difluorophenyl group, a trifluorophenyl group, a chlorophenyl group, a dichlorophenyl group, a trichlorophenyl group, a bromophenyl group, a dibromophenyl group, an iodophenyl group, a fluorotolyl group, and a chlorotolyl group; (for example, C6-10) hydroxy, alkoxy, cyano, formyl, or nitro substituted, or acylated aromatic hydrocarbon groups such as a hydroxyphenyl group, a methoxyphenyl group, a dimethoxyphenyl group, a trimethoxyphenyl group, a methoxytolyl group, an ethoxyphenyl group, a propoxyphenyl group, an isopropoxyphenyl group, a butoxyphenyl group, a nitrophenyl group, a cyanophenyl group, a formylphenyl group, and an acetylphenyl group; and heterocyclic groups such as a furan-2-yl group, a thiophene-3-yl group, a thiophene-2-yl group, a benzofuran-2-yl group, and a benzo[b]thiophene-2-yl group.

An example of a monoester of an organic boronic acid as used herein is a monoester of this organic boronic acid, and any of various alcohols described above in relation to a monoester of the divalent aliphatic dicarboxylic acid.

Examples of a sulfate monoester, a phosphate monoester, a phosphite monoester, and a boronate monoester as used herein include monoesters of sulfuric acid, orthophosphoric acid, phosphorous acid, and orthoboric acid, respectively, and any of various alcohols described above in relation to a monoester of the divalent aliphatic dicarboxylic acid.

Examples of a phosphate diester as used herein include a monoester of orthophosphoric acid, and any of various alcohols described above in relation to a monoester of the divalent aliphatic dicarboxylic acid; and examples of a boronate diester as used herein include a monoester of orthoboric acid, and any of the foregoing alcohols.

A preferred example of a substituted phenol as used herein is a substituted phenol having a lower pKa than the unsubstituted phenol. Such a substituted phenol usually has at least one substituent that functions as an electron-withdrawing group for aromatic rings. Examples of such an electron-withdrawing group include acyl groups such as an acetyl group, a formyl group, a carboxy group, an alkoxycarbonyl group, a nitro group, a cyano group, and a halogeno group (such as a fluoro group, a chloro group, a bromo group, and an iodine group). Examples of an alcohol corresponding to the alkoxy group of an alkoxycarbonyl group as used herein include various alcohols described above in relation to a monoester of the divalent aliphatic dicarboxylic acid. Examples of the above-described substituted phenol include acetylphenol, formylphenol, carboxyphenol, methoxycarbonylphenol, ethoxycarbonylphenol, nitrophenol, cyanophenol, fluorophenol, chlorophenol, bromophenol, and iodophenol. The carbon number of this substituted phenol can be preferably 6 to 13, or 6 to 11, or 6 to 9.

The component (ii) is at least one second amide compound having a structure such that an amino group and at least one hydroxy group of the at least one alkanolamine (a3) represented by the general formula (1) are acylated with the monovalent fatty acid (a1). The component (ii) has the structure represented by the following general formula (17a), (17b) or (17c). The general formulae (17a) and (17b) show the structures corresponding to the dialkanolamine, and the general formula (17c) shows the structure corresponding to the monoalkanolamine. In one preferred embodiment, the component (ii) has a structure such that an amino group and at least one hydroxy group of at least one dialkanolamine represented by the general formula (1) are acylated with the monovalent fatty acid (a1), and this structure is represented by the general formula (17a) or (17b).

(17a)

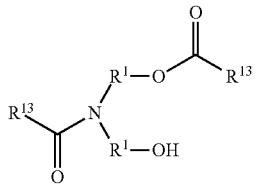

(17b)

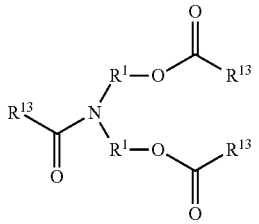

(17c)

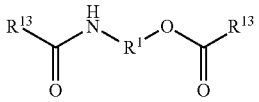

(in the general formulae (17a) to (17c), $R^1$'s are as defined in the above; in the general formulae (17a) and (17b), two $R^1$'s in the same molecule may be the same, and may be different from each other, and represent the two alkylene groups of the corresponding dialkanolamine; in the general formula (17c), $R^1$ represents the alkylene group of the corresponding monoalkanolamine; $R^{13}$'s are each an aliphatic hydrocarbon group obtained by removing the carboxy group from the monovalent fatty acid (a1); when the monovalent fatty acid (a1) is one fatty acid, a plurality of $R^{13}$'s in the same molecule are the same aliphatic hydrocarbon groups; and when the monovalent fatty acid (a1) is a combination of at least two different fatty acids, a plurality of $R^{13}$'s in the same molecule are the same aliphatic hydrocarbon groups, or at least two different aliphatic hydrocarbon groups in combination correspondingly to the combination of at least two different fatty acids.)

The content of the component (ii) in the lubricating oil additive composition is no less than 8.0 mass % on the basis of the total content in terms of entire acylated compound obtained by acylating, with the monovalent fatty acid (a1), a compound having an alkanolamine structure where a hydroxy group may be etherified in a state of forming no salt in view of improving storage stability, in view of improving friction reducing performance, especially friction reducing performance in a mixed lubrication regime, such as lubricating conditions for gears, and in view of improving fatigue resistance. This content on the basis of the total content in terms of entire acylated compound obtained by acylating, with the monovalent fatty acid (a1), a compound having an alkanolamine structure where a hydroxy group may be etherified in a state of forming no salt is preferably no more than 95 mass %, or no more than 93 mass % in view of further improving friction reducing performance, in view of further improving friction reducing performance in a mixed lubrication regime, especially, lubricating conditions for gears or the like, and in view of further improving fatigue resistance; and in one embodiment, can be 8.0 to 95 mass %, or 9.0 to 93 mass %, or 10.0 to 91 mass %.

In this description, the "compound having an alkanolamine structure" in the "entire acylated compound obtained by acylating, with the monovalent fatty acid (a1), a compound having an alkanolamine structure where a hydroxy group may be etherified" is the concept encompassing any compounds including any alkanolamine structures, that is, HO—$R^{14}$—$NR^{15}R^{16}$ structures ($R^4$ represents any alkylene group; and $R^{15}$ and $R^{16}$ each independently represent a hydrogen atom, or any organic group, and may bond to each other to form a ring structure). That the "hydroxy group" of the "alkanolamine structure . . . may be etherified" means a hydroxy (—OH) group in the alkanolamine structure (HO—$R^{14}$—$NR^{15}R^{16}$ structure) may be converted to an ether bond. An example of the "alkanolamine structure where a hydroxy group is etherified" is a structure obtained by converting a hydroxy group in an alkanolamine to an ether bond by intermolecular or intramolecular dehydration condensation. In order for an alkanolamine to form an ether bond by intramolecular dehydration condensation, it is necessary that at least two hydroxy groups be present in one single molecule. For example, dialkanolamines satisfy this requirement. Formation of an ether bond by an intramolecular dehydration condensation reaction on an alkanolamine is a cyclization reaction, which can give an azaoxacycloalkane skeleton (such as a morpholine skeleton). Such an intramolecular dehydration cyclization reaction will be described later. The "entire acylated compound obtained by acylating, with the monovalent fatty acid (a1)" is the concept encompassing any acylated compounds obtained by acylation with the monovalent fatty acid (a1), and for example, may be an amide of the fatty acid (a1), may be an ester of the fatty acid (a1), and may be a compound where a plurality of moieties in one molecule thereof is acylated with the fatty acid (a1). The "total content in terms of entire acylated compound . . . in a state of forming no salt" can be calculated by adding the content of compound forming no salt, and adding the content of compound the whole or part of which forms a salt assuming that the compound forms no salt (for example, when all or a part of amino groups which are not acylated are/is neutralized by acid in the compound, the content in terms of mass in a state where no neutralization by acid is performed).

The content of the component (i) in the lubricating oil additive composition on the basis of the total content in terms of entire acylated compound obtained by acylating, with the monovalent fatty acid, a compound having an alkanolamine structure where a hydroxy group may be etherified in a state of forming no salt in terms of compound in a state of forming no salt is preferably no less than 1.0 mass %, or no less than 2.0 mass %, or no less than 4.0 mass % in view of further improving friction reducing performance, especially friction reducing performance in a mixed lubrication regime, such as lubricating conditions for gears; is preferably no more than 80 mass %, or no more than 70 mass %, or no more than 60 mass % in the same view, and in one embodiment, can be 1.0 to 80 mass %, or 2.0 to 70 mass %, or 4.0 to 60 mass %, or 5.0 to 52 mass %. The first amide compound has at least one amino group that can form a salt.

In this description, the content of the component (i) "in terms of compound in a state of forming no salt" means the content of the component (i) as it is when the first amide compound forms no salt at all, and means the content of the component (i) in terms of mass in a state where no neutralization by acid is performed when the whole or part of the first amide compound forms a salt along with acid.

The total content of the components (i) and (ii) in the lubricating oil additive composition on the basis of the total content in terms of entire acylated compound obtained by acylating, with the monovalent fatty acid (a1), a compound having an alkanolamine structure where a hydroxy group may be etherified in a state of forming no salt in terms of compound in a state of forming no salt is preferably no less than 56 mass %, or no less than 58 mass % in view of further improving storage stability, in view of further improving friction reducing performance, especially friction reducing performance in a mixed lubrication regime, such as lubricating conditions for gears, and in view of further improving fatigue resistance; is preferably no more than 99 mass %, or no more than 98 mass % in view of easy production; and in one embodiment, can be 56 to 99 mass %, or 58 to 98 mass %, or 60 to 96 mass %.

In one embodiment, the lubricating oil additive composition can further comprise (iii) a third amide compound that is an amide of the at least one alkanolamine (a3) represented by the general formula (1), and the monovalent fatty acid (a1), and that has no ester bond (hereinafter may be referred to as the "component (iii)") in addition to the components (i) and (ii). The third amide compound has the structure represented by the following general formula (18a) or (18b). The general formula (18a) shows the structure corresponding to the dialkanolamine, and the general formula (18b) shows the structure corresponding to the monoalkanolamine. In one preferred embodiment, the component (iii) has a structure such that an amino group and at least one hydroxy group of the at least one dialkanolamine represented by the general formula (1) are acylated with the monovalent fatty acid (a1), and this structure is represented by the general formula (18a).

(18a)

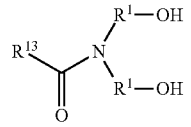

(18b)

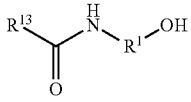

(in the general formulae (18a) and (18b), $R^1$'s are as defined in the above, and $R^{13}$'s are as defined in the general formulae (17a) to (17c)).

According to the lubricating oil additive composition of the present invention, the components (i) and (ii) are contained whereby further improved friction reducing performance, especially further improved friction reducing performance in a mixed lubrication regime can be obtained while the solubility in the base oil is maintained even compared with the case where the component (iii) is used alone as a friction modifier.

In one embodiment, the lubricating oil additive composition can further comprise a fourth amide compound, and/or a salt thereof, the fourth amide compound having a structure such that at least one amino group and at least one hydroxy group of the amine compound (a2) are acylated with the monovalent fatty acid (a1) (hereinafter may be referred to as the "component (iv)"), in addition to the components (i) and (ii), or in addition to the components (i), (ii) and (iii). The fourth amide compound is different from the first amide compound in having not only an amide bond but also an ester bond. The fourth amide compound can have at least one amino group that can form a salt. Examples of an acid that can form a salt along with the fourth amide compound include various acids described above concerning the (B1) component.

In one embodiment, the total content of the components (iii) and (iv) in the lubricating oil additive composition on the basis of the total content in terms of entire acylated compound obtained by acylating, with the monovalent fatty acid (a1), a compound having an alkanolamine structure where a hydroxy group may be etherified in a state of forming no salt in terms of compound in a state of forming no salt can be, for example, no more than 60 mass %, or no more than 42 mass %; is preferably no less than 0.10 mass %, or no less than 1.0 mass % in view of easy production; and in one embodiment, can be 0.10 to 60 mass %, or 1.0 to 42 mass %.

The total content of the components (ii) and (iii) in the lubricating oil additive composition on the basis of the total content in terms of entire acylated compound obtained by acylating, with the monovalent fatty acid (a1), a compound having an alkanolamine structure where a hydroxy group may be etherified in a state of forming no salt is preferably no less than 20 mass %, or no less than 50 mass %, or more than 85 mass %, or no less than 86 mass % in view of easy production, and in view of further improving storage stability; in one embodiment, can be no more than 99 mass %, or no more than 96 mass %; and in one embodiment, can be 20 to 99 mass %, or 50 to 99 mass %, or more than 85 mass % and no more than 99 mass %, or 86 to 99 mass %.

(Production)

For example, the amine compound (a2), that is, the alkanolamine oligomer can be produced by dehydration condensation on the at least one alkanolamine (a3). The amine compound (a2) may be an oligomer having a single degree of polymerization, and may be any combination of at least two oligomers having different degrees of polymerization (for example, the combination of oligomers having a plurality of different consecutive degrees of polymerization).

In one embodiment, the component (i) can be produced by the dehydration condensation reaction of the fatty acid (a1) with the amine compound (a2). For example, such a dehydration condensation reaction can be carried out by removing, by azeotropy, water generated following the progress of the condensation reaction while refluxing the fatty acid (a1) and the amine compound (a2) in an organic solvent that forms an azeotrope along with water (such as toluene, xylene, cumene, and cymene) in the presence of an acid catalyst (such as sulfuric acid, and trifluoroacetic acid) or a base catalyst (such as sodium carbonate, sodium hydroxide, potassium hydroxide, sodium acetate, sodium phosphate, triethylamine, and pyridine), or without a catalyst. In the condition of no catalyst, the fatty acid (a1) and/or the amine compound (a2) themselves can function as a catalyst.

In the same manner, in one embodiment, the component (ii) can be produced by the dehydration condensation reaction of the fatty acid (a1) and the alkanolamine (a3). For example, such a dehydration condensation reaction can be carried out by removing, by azeotropy, water generated following the progress of the condensation reaction while refluxing the fatty acid (a1) and the alkanolamine (a3) in the presence of an organic solvent that forms an azeotrope along with water.

In another embodiment, the component (i) can be produced by reacting, in a solvent, the fatty acid (a1), the amine compound (a2), and a condensation agent. In the same manner, in one embodiment, the component (ii) can be produced by reacting, in a solvent, the fatty acid (a1), the alkanolamine (a3), and a condensation agent. The following known condensation agents that can be used for esterification can be used as a condensation agent as used herein without particular limitations: carbodiimide-based condensation agents such as N,N'-dicyclohexylcarbodiimide (DCC), N,N'-diisopropylcarbodiimide (DIC), and 1-ethyl-3-(3-dimethylaminopropyl)carbodiimide (EDC); imidazole-based condensation agents such as N,N'-carbonyldiimidazole (CDI), and 1,1'-carbonyldi(1,2,4-triazole) (CDT); triazine-based condensation agents such as 4-(4,6-dimethoxy-1,3,5-triazine-2-yl)-4-methylmorpholinium chloride hydrate (DMT-MM); 2-halopyridinium salts such as 2-chloro-1-methylpyridinium p-toluenesulfonate, and 2-fluoro-1-methylpyridinium p-toluenesulfonate; 2,4,6-trichlorobenzoyl chloride (TCBC); 2-methyl-6-nitrobenzoic anhydride (MNBA); combinations of diethyl azodicarboxylate (DEAD) and triphenylphosphine; phosphines such as chlorodiphenylphosphine, and 2,2'-dipyridyl disulfide; combinations of p-benzoquinones including 2,6-dimethyl-1,4-benzoquinone (DMBQ), and tetrafluoro-1,4-benzoquinone; and dimesitylammonium pentafluorobenzenesulfonate. The condensation agent may be used along with a catalyst such as 4-dimethylaminopyridine (DMAP), N-hydroxysuccinimide (NHS), 1-hydroxybenzotriazole (HOBt), and 1-hydroxy-7-azabenzotriazole (HOAt).

In another embodiment, the component (i) can be produced by reacting, in a solvent, an acylating agent derived from the fatty acid (a1), and the amine compound (a2). In the same manner, in one embodiment, the component (ii) can be produced by reacting, in a solvent, an acylating agent derived from the fatty acid (a1), and the alkanolamine (a3). Examples of an acylating agent derived from the fatty acid (a1) include acid halides of the fatty acid (a1) (such as acid chlorides and acid bromides), active esters of the fatty acid (a1) (such as esters of the fatty acid (a1) and N-hydroxysuccinimide (NHS), esters of the fatty acid (a1) and 1-hydroxybenzotriazole (HOBt), and esters of the fatty acid (a1) and 1-hydroxy-7-azabenzotriazole (HOAt)), and acid anhydrides of the fatty acid (a1). The acylating agent derived from the fatty acid (a1) may be used along with a catalyst such as 4-dimethylaminopyridine (DMAP). As a solvent as used herein, an organic solvent that does not inhibit the condensation reaction (such as aliphatic hydrocarbon solvents including hexane and petroleum ether, aromatic hydrocarbon solvents including benzene, toluene, and xylene, halogenated hydrocarbon solvents including dichloromethane, 1,2-dichloroethane, chlorobenzene, and o-dichlorobenzene, and pyridine) can be used without particular limitation. In the condensation reaction to produce the component (i) and/or component (ii), if necessary, a proper base (such as amines including triethylamine, pyridine, and 2,6-lutidine, organolithium reagents such as butyllithium, and inorganic bases such as potassium carbonate) may be added to the reaction mixture for the purpose of promoting the reaction, or for the purpose of trapping acid generated following the progress of the reaction (for example, in the reaction using an acid halide, halogenated hydrogen is generated following the progress of the reaction).

In another embodiment, the component (i) can be produced by the dehydration condensation reaction of the component (iii) (third amide compound that is an amide of the at least one alkanolamine (a3) represented by the general formula (1), and the monovalent fatty acid (a1), and that has no ester bond) with the alkanolamine (a3) and/or the amine compound (a2). For example, such a dehydration condensation reaction can be carried out by removing, by azeotropy, water generated following the progress of the condensation reaction while refluxing the component (iii), and the alkanolamine (a3) or the amine compound (a2) or a mixture thereof in an organic solvent that forms an azeotrope along with water in the presence of an acid catalyst.

The foregoing various dehydration condensation reactions can be carried out in the condition of no solvent. For example, water generated following the progress of the reaction can be distilled out and removed while the dehydration condensation reaction is carried out in the condition of no solvent.

In one preferred embodiment, a mixture containing the components (i) and (ii) can be produced by the dehydration condensation reaction of the fatty acid (a1) and the alkanolamine (a3). In one embodiment, such a dehydration condensation reaction can be carried out by removing, by azeotropy, water generated following the progress of the condensation reaction while refluxing the fatty acid (a1) and the alkanolamine (a3) in the presence of an organic solvent that forms an azeotrope along with water.

In another embodiment, when the boiling point of the alkanolamine (a3) is higher than that of water, such a dehydration condensation reaction can be carried out by gradually raising the heating temperature so as to continuously distil out water generated by the reaction while heating and stirring the fatty acid (a1) and the alkanolamine (a3) in the condition of no solvent, and continuing the heating and stirring until the water is not distilled out although the temperature is raised more.

The dehydration condensation reaction can be also carried out in the condition of no solvent. For example, water generated following the progress of the reaction can be distilled out and removed while the dehydration condensation reaction is carried out in the condition of no solvent.

In the dehydration condensation reaction, the component (iii) and/or component (iv) can be produced as side products. In this reaction, the reaction molar ratio ((a3)/(a1)) of the fatty acid (a1) and the alkanolamine (a3) can be, for example, 0.01 to 100, preferably 0.02 to 50, or 0.5 to 5, or 1.5 to 2.0.

In the dehydration condensation reaction, the reaction of disproportionating two molecules of the dialkanolamine (a3d) to one molecule of the monoalkanolamine (a3m) and one molecule of a trialkanolamine (a3t) (following general formula (19)) can progress at the same time as a side-reaction.

(19)

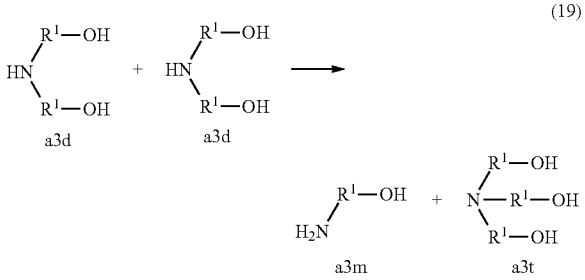

The fatty acid (a1) coexisting in the system functions as an acid catalyst whereby this disproportionation reaction is considered to be promoted. The generated monoalkanolamine (a3m) can further take part in a dehydration condensation reaction with another alkanolamine molecule. Therefore, even when an alkanolamine used as a raw material is formed of the at least one dialkanolamine (a3d), the structure of the alkanolamine oligomer of the generated amine compound (a2) can include a structural unit derived from the monoalkanolamine (a3m).

Such a disproportionation reaction can progress even after the structure of the alkanolamine oligomer is formed. For example, by the reaction of an alkanolamine dimer (such as the dialkanolamine dimer (a2-dd)) with an alkanolamine (dialkanolamine (a3d) or monoalkanolamine (a3m)), an alkanolamine dimer where the number of the hydroxyalkyl (—$R^1$—OH) groups is decreased by one (such as a2-dm or a2-md), and an alkanolamine where the number of the hydroxyalkyl groups is increased by one (trialkanolamine (a3t) or dialkanolamine (a3d)) can be generated (following general formula (20)).

(20)

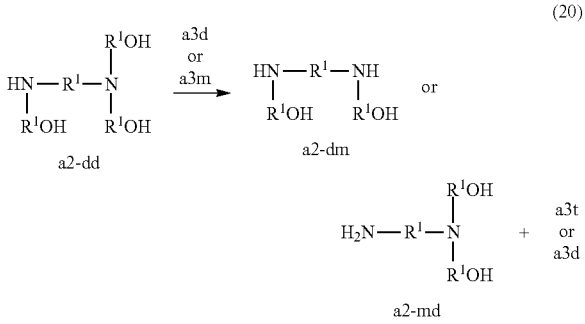

In the foregoing dehydration condensation reaction, the cyclization reaction of the structure of the alkanolamine oligomer can further progress as a side-reaction. For example, when two hydroxyalkyl (—$R^1$—OH) groups bonded to the same nitrogen atom are present, an azaoxacycloalkane skeleton such as a morpholine skeleton can be formed by an intramolecular dehydration cyclization reaction. For example, the alkanolamine dimer (a2-dd) having amino groups one of which is a bis(hydroxyalkyl)amino group, and the other one of which is a secondary amino group (see the general formula (4)) can give a cyclized product (cao-a2-dd) by an intramolecular dehydration reaction, and the cyclized product (cao-a2-dd) can further give a dehydration condensation product along with the fatty acid (a1) (acyl-cao-a2-dd). Instead, after the dehydration condensation reaction of the dialkanolamine dimer (a2-dd) and the fatty acid (a1) progresses and gives an amide compound (acyl-a2-dd), the cyclized product (acyl-caa-a2-dd) can be generated by an intramolecular dehydration reaction (following general formula (21)).

(21)

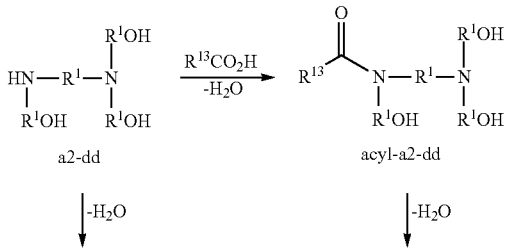

-continued

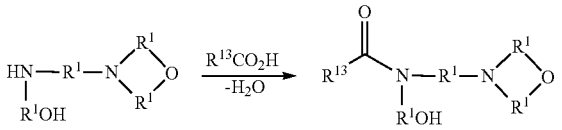

Similarly, the alkanolamine dimer (a2-md) having amino groups one of which is a bis(hydroxyalkyl)amino group, and the other one of which is a primary amino group can also give a cyclized product by an intramolecular dehydration reaction (following general formula (22)).

(22)

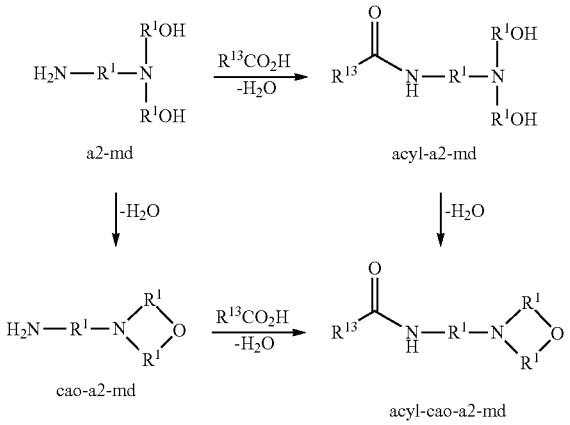

Such an intramolecular dehydration cyclization reaction to form an azaoxacycloalkane skeleton easily progresses when the carbon number of the main chain of $R^1$, which is an alkylene group, is 2. In such a case, a morpholine skeleton is formed.

For example, in an alkanolamine oligomer having a degree of polymerization of no less than 2, when the structure such that two remaining valences of $R^1$, which is an alkylene group, are bonded to the nitrogen atom to which a hydroxyalkyl (—$R^1$—OH) group is bonded, and the primary or secondary amino group is present, the intramolecular dehydration cyclization reaction by which a diazacycloalkane skeleton is formed can progress as a side-reaction. In other words, in an alkanolamine oligomer having a degree of polymerization of no less than 2, when the structure such that at least one hydrogen atom is bonded to one of the two nitrogen atoms bonded to $R^1$, which is an alkylene group, and at least one hydroxyalkyl (—$R^1$—OH) group is bonded to the other nitrogen atom is present, the intramolecular dehydration cyclization reaction by which a diazacycloalkane skeleton is formed can progress as a side-reaction. For example, the alkanolamine dimer having amino groups one of which is a bis(hydroxyalkyl)amino group, and the other one of which is a primary amino group (a2-md) can give a cyclized product having a diazacycloalkane skeleton (caa-a2-md) by an intramolecular dehydration reaction, and the acylation reaction of this cyclized product (caa-a2-md) with the fatty acid (a1) can further progress (following general formula (23)).

(23)

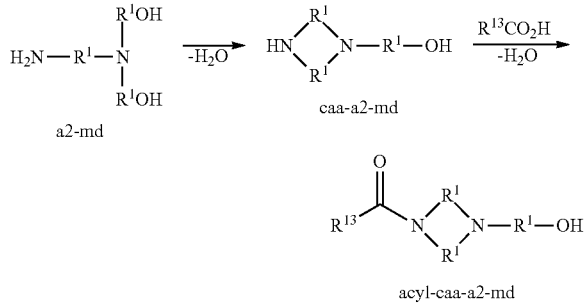

For example, the alkanolamine dimer having two amino groups both of which are secondary amino groups (a2-dm) gives the cyclized product having a diazacycloalkane skeleton (caa-a2-md) by an intramolecular dehydration reaction, and the acylation reaction of this cyclized product (caa-a2-md) with the fatty acid (a1) can further progress. Instead, after the dehydration condensation reaction of the dialkanolamine dimer (a2-dm) with the fatty acid (a1) progresses and gives an amide compound (acyl-a2-dm), an cyclized product (acyl-caa-a2-md) can be generated by an intramolecular dehydration reaction (following general formula (24)).

(24)

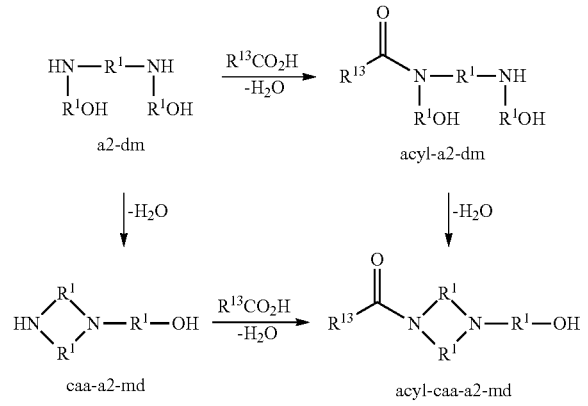

For example, the alkanolamine dimer having amino groups one of which is a secondary amino group, and the other one of which is a tertiary amino group (a2-dd) gives a cyclized product having a diazacycloalkane skeleton (caa-a2-dd) by an intramolecular dehydration reaction, and the acylation reaction of this cyclized product (caa-a2-dd) with the fatty acid (a1) can further progress (following general formula (25)).

(25)

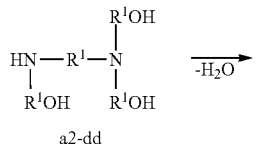

-continued

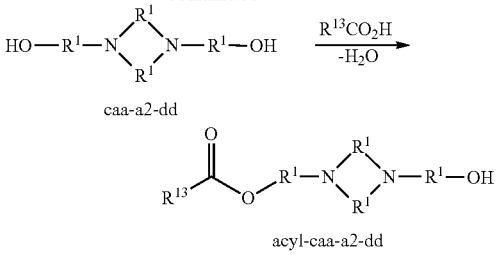

Such an intramolecular dehydration cyclization reaction to form a diazacycloalkane skeleton easily progresses when the carbon number of the main chain of $R^1$, which is an alkylene group, is 2. In such a case, a piperazine skeleton is formed.

The amount of side products which are generated via the intramolecular dehydration cyclization reaction of the alkanolamine (a3) or the structure of the alkanolamine oligomer, each of which has a ring structure, and which are acylated with the monovalent fatty acid (a1) (hereinafter may be referred to as the "component (v)" or "(v) component") is usually small even when the side products are generated. The total content of the side products in the additive composition on the basis of the total content in terms of entire acylated compound obtained by acylating, with the monovalent fatty acid (a1), a compound having an alkanolamine structure where a hydroxy group may be etherified in a state of forming no salt in terms of compound in a state of forming no salt can be, for example, 0 to 2.0 mass %, or 0 to 5.0 mass %.

After the condensation reaction of the fatty acid (a1) with the dialkanolamine (a3) is completed, the unreacted raw material can be removed by a known technique such as washing, silica gel short pass column chromatography, and a celite filter. In such an operation, a solvent can be used as appropriate. As a solvent as used herein, pentane, hexane, cyclohexane, heptane, benzene, toluene, xylene, diethyl ether, ethyl acetate, tetrahydrofuran, methanol, ethanol, isopropyl alcohol, dichloromethane, chloroform, carbon tetrachloride, or the like can be used. Even the content of the component (i) and/or component (ii) can be adjusted by further purifying the obtained product by the use of a known purifying means such as column chromatography. Here, washing means washing with water or an aqueous solution. As an aqueous solution for the washing, an acidic water such as dilute hydrochloric acid, an alkaline water such as dilute aqueous sodium hydroxide solutions, an aqueous salt solution such as saturated saline solution, or the like can be used.

In this description, the contents of the components (i) to (v) in a sample can be measured with a high performance liquid chromatograph (HPLC). The measurement conditions for HPLC are as follows.

[HPLC Measurement Conditions]

- device: UltiMate 3000 UHPLC manufactured by Thermo Fisher Scientific
- column: ACQUITY (registered trademark) UPLC BEH manufactured by Waters Corporation,
- C18: 1.7 μm, 50×2.1 mm (ODS)
- detector: charged aerosol detector (CAD) and mass spectrometry (MS) in combination charged aerosol detector (CAD): Corona (registered trademark) Veo (registered trademark) RS manufactured by Thermo Fisher Scientific, drying tube temperature: 35° C.
- mass spectrometry (MS): JMS-T100LP AccuTOF (registered trademark) LC-plus 4G manufactured by JEOL Ltd. (ionization: ESI+)
- mobile phase: gradient elution using ultrapure water, methanol, and isopropyl alcohol is used. Ammonium formate is added to each solvent so as to be 10 mmol/L in concentration. The composition has a water/methanol mixing volume ratio of 20/80 at the start timing, is consecutively changed to have 100% methanol, and thereafter, is further changed consecutively to have 100% isopropyl alcohol.
- column temperature: 40° C. sample solution: methanol solution having a sample concentration of approximately 100 mass ppm
- sample injection volume: 1.0 μL Based on the detection results of the mass spectrometry (MS), each detected peak of the charged aerosol detector (CAD) can be assigned to a compound. When the analysis conditions are the same, the detected peaks of CAD show the area values according to the amount of the compound flowing into the detector irrespective of characteristics of the compound. Therefore, the content of each of the components (mass % in terms of compound in a state of forming no salt) can be quantitatively measured by using the peak area values of CAD. When one detected peak of CAD includes a plurality of compounds, the content of each of the components (mass % in terms of compound in a state of forming no salt) can be calculated by proportionally dividing the area value of the detected peak of CAD according to the ratio of the peak area values of MS as for these plural compounds.

In the above measurement method, the detected peaks of the components (i), (ii), (iv) and (v) in the chromatogram of CAD are separate from each other. A group of the detected peaks of fatty acid acylated compounds of the alkanolamine oligomer in the chromatogram of CAD is separate from a group of the detected peaks of fatty acid acylated compounds of the alkanolamine monomer. The detected peak of the component (ii) (that is, the compound formed by acylating the amino group and at least one hydroxy group of the alkanolamine monomer with the fatty acid) in the chromatogram of CAD is separate from the detected peak of the fatty acid monoacylated compound of the alkanolamine monomer. The detected peak of the component (iii) (that is, the fatty acid amide of the alkanolamine monomer that has no ester bond) in the chromatogram of CAD is separate from each of the detected peaks of the components (i), (ii), (iv) and (v), but may not be separate from the detected peak of the monoester that is the fatty acid monoacylated compound of the alkanolamine monomer, and in order to calculate the content of the component (iii), it may be necessary to proportionally divide the detected peak area value of CAD based on the detected peak areas of MS. When a fatty acid and an alkanolamine are given, a monoamide and a monoester thereof have the same molecular weight, but show different fragment patterns of MS. Thus, both can be distinguished based on the detection results of MS.

When a sample containing the components (i) to (v), the contents of which are to be measured, is not a complete solution (contains impurities, or is a suspension), the measurement can be performed after a solution is obtained by known pretreatment such as filtration. Before the measurement by high performance liquid chromatography (C18 column, detector: CAD and MS) is performed, if necessary, pretreatment of removing all or a part of the components other than the components (i) to (v) by known purifying means such as silica gel column chromatography, and preparative liquid chromatography (such as gel permeation chromatography (GPC)) may be performed.

<2. Lubricating Oil Composition>

A lubricating oil composition according to the second aspect of the present invention (hereinafter may be referred to as a "lubricating oil composition" or "composition") comprises a lubricant base oil in a major amount, and at least one additive other than the base oil. In the lubricating oil composition according to the present invention, a lubricant base oil comprising at least one mineral base oil or at least one synthetic base oil or any combination thereof is used as the lubricant base oil.

At least one mineral base oil, at least one synthetic base oil, or any mixed base oil thereof can be used as the lubricant base oil. In one embodiment, as the lubricant base oil, a Group I base oil of API base stock categories (hereinafter may be referred to as the "API Group I base oil"), a Group II base oil thereof (hereinafter may be referred to as the "API Group TT base oil"), a Group III base oil thereof (hereinafter may be referred to as the "API Group III base oil"), a Group IV base oil thereof (hereinafter may be referred to as the "API Group IV base oil"), or a Group V base oil thereof (hereinafter may be referred to as the "API Group V base oil"), or any mixed base oil thereof can be used. The API Group I base oil is a mineral base oil containing more than 0.03 mass % sulfur and/or less than 90 mass % saturates, and having a viscosity index of no less than 80 and less than 120. The API Group II base oil is a mineral base oil containing no more than 0.03 mass % sulfur and no less than 90 mass % saturates, and having a viscosity index of no less than 80 and less than 120. The API Group III base oil is a mineral base oil containing no more than 0.03 mass % sulfur and no less than 90 mass % saturates, and having a viscosity index of no less than 120. The API Group IV base oil is a poly-α-olefin base oil. The API Group V base oil is a base oil other than the Groups I to IV base oils, and a preferred example thereof is an ester base oil.

In one embodiment, as the (A) component, at least one API Group II base oil, at least one API Group III base oil, at least one API Group IV base oil, or at least one API Group V base oil, or any combination thereof can be preferably used.

Examples of the mineral base oil include: a paraffinic base oil, a normal-paraffinic base oil, and an isoparaffinic base oil which are refined with lubricating oil fractions obtained by atmospheric distillation and/or vacuum distillation of crude oil through one, or two or more selected from refining processes such as solvent deasphalting, solvent extraction, hydrocracking, solvent dewaxing, catalytic dewaxing, hydrorefining, sulfuric acid washing, and white clay treatment in combination; and mixtures thereof. The API Group II base oil and the API Group III base oil are usually produced via hydrocracking.

The % $C_P$ of the mineral base oil is preferably no less than 60, and more preferably no less than 65 in view of further improving the viscosity-temperature characteristics of the composition, and fuel efficiency; is preferably no more than 99, more preferably no more than 95, and further preferably no more than 94 in view of improving solubility of additives; and in one embodiment, can be 60 to 99, or 60 to 95, or 65 to 95, or 65 to 94.

The % $C_A$ of the mineral base oil is preferably no more than 2, more preferably no more than 1, further preferably no more than 0.8, and especially preferably no more than 0.5 in view of further improving the viscosity-temperature characteristics of the composition, and fuel efficiency.

The % $C_N$ of the mineral base oil is preferably no less than 1, and more preferably no less than 4 in view of improving solubility of additives; is preferably no more than 40, and more preferably no more than 35 in view of further improving the viscosity-temperature characteristics of the composition, and fuel efficiency; and in one embodiment, can be 1 to 40, or 4 to 35.

In the present description, % $C_P$, % $C_N$ and % $C_A$ mean a percentage of the paraffinic carbon number to the total carbon number, a percentage of the naphthenic carbon number to the total carbon number, and a percentage of the aromatic carbon number to the total carbon number, respectively, which are obtained by the method conforming to ASTM D 3238-85 (ring analysis by the n-d-M method). That is, the foregoing preferred ranges of the % $C_P$, % $C_N$ and % $C_A$ are based on the values obtained according to this method. For example, the value of the % $C_N$ obtained according to this method can be more than 0 even if the lubricant base oil has no naphthene content.

The saturated content in the mineral base oil is preferably no less than 90 mass %, more preferably no less than 95 mass %, and further preferably no less than 99 mass % on the basis of the total mass of the base oil in view of improving the viscosity-temperature characteristics of the composition. In the present description, the saturated content means the value measured conforming to ASTM D 2007-93.

The aromatic content in the mineral base oil on the basis of the total mass of the base oil is preferably 0 to 10 mass %, more preferably 0 to 5 mass %, and especially preferably 0 to 1 mass %; and in one embodiment, can be no less than 0.1 mass %. The aromatic content of no more than this upper limit can lead to improvement in low-temperature viscosity characteristics and viscosity-temperature characteristics of the fresh oil, and in addition, further improvement in fuel efficiency, and reduction in evaporation loss of the lubricating oil to reduce the consumption of the lubricating oil; and can also cause effects of additives to be exerted effectively when the additives are incorporated to the lubricant base oil. The lubricant base oil may have no aromatic content, whereas the aromatic content of no less than the foregoing lower limit can lead to improvement in solubility of additives.

In the present description, the aromatic content means the value measured conforming to ASTM D 2007-93. Generally, the aromatic content includes alkylbenzenes and alkylnaphthalenes; anthracenes, phenanthrenes and alkylated products thereof; further, compounds each having four or more fused benzene rings; and aromatic compounds each having a heteroatom, such as pyridine, quinoline, phenol, and naphthol.

Examples of the API Group IV base oil include: oligomers and co-oligomers of C2-32, preferably C6-16 α-olefins, such as ethylene-propylene copolymers, polybutene, 1-octene oligomers, and 1-decene oligomers, and hydrogenated products thereof; and hydrogenated products thereof.

Preferred Examples of the API Group V base oil include ester base oils such as: monoesters (such as butyl stearate, octyl laurate, and 2-ethylhexyl oleate); diesters (such as ditridecyl glutarate, bis(2-ethylhexyl) adipate, diisodecyl adipate, ditridecyl adipate, and bis(2-ethylhexyl) sebacate); polycarboxylates (such as trimellitate esters); and polyol esters (such as trimethylolpropane caprylate, trimethylolpropane pelargonate, pentaerythritol 2-ethylhexanoate, and pentaerythritol pelargonate). Other examples of the API Group V base oil include aromatic synthetic base oils such as alkylbenzenes, alkylnaphthalenes, polyoxyalkylene glycols, dialkyl diphenyl ethers, and polyphenyl ethers.

The kinematic viscosity of the lubricant base oil (total base oil) at 40° C. is no more than 40 $mm^2/s$, preferably no more than 30 $mm^2/s$, and more preferably no more than 20

$mm^2/s$ in view of improving energy saving performance, and the low-temperature viscosity characteristics of the lubricating oil composition; is preferably no less than 5.0 $mm^2/s$, more preferably no less than 6.0 $mm^2/s$, and further preferably no less than 7.0 $mm^2/s$ in view of improving anti-wear performance and anti-seizure performance; and in one embodiment, can be 5.0 to 40 $mm^2/s$, or 6.0 to 30 $mm^2/s$, or 7.0 to 20 $mm^2/s$. In the present description, the "kinematic viscosity at 40° C." means the kinematic viscosity at 40° C. measured conforming to JIS K 2283-2000 by the use of an automated viscometer (trade name: "CAV-2100" manufactured by Cannon instrument company) as a measuring device.

The kinematic viscosity of the lubricant base oil (total base oil) at 100° C. is preferably no more than 10.0 $mm^2/s$, more preferably no more than 7.0 $mm^2/s$, and further preferably no more than 4.0 $mm^2/s$ in view of further improving energy saving performance, and the low-temperature viscosity characteristics of the lubricating oil composition; is preferably no less than 1.0 mm 2/s, more preferably no less than 2.0 $mm^2/s$, and further preferably no less than 3.0 $mm^2/s$ in view of improving anti-wear performance and anti-seizure performance; and in one embodiment, can be 1.0 to 10 $mm^2/s$, or 2.0 to 7.0 $mm^2/s$, or 3.0 to 4.0 $mm^2/s$. In the present description, the "kinematic viscosity at 100° C." means the kinematic viscosity at 100° C. measured conforming to JIS K 2283-2000 by the use of an automated viscometer (trade name: "CAV-2100" manufactured by Cannon instrument company) as a measuring device.

The viscosity index of the lubricant base oil (total base oil) is preferably no less than 100, more preferably no less than 105, further preferably no less than 110, particularly preferably no less than 115, and most preferably no less than 120 in view of improving the viscosity-temperature characteristics of the composition, and in view of further improving fuel efficiency and anti-wear performance. In the present description, the viscosity index means the viscosity index measured conforming to JIS K 2283-2000 by the use of an automated viscometer (trade name: "CAV-2100" manufactured by Cannon instrument company) as a measuring device The pour point of the lubricant base oil (total base oil) is preferably no more than −10° C., more preferably no more than −12.5° C., further preferably no more than −15° C., especially preferably no more than −17.5° C., and most preferably no more than −20.0° C. in view of the low-temperature fluidity of the entire lubricating oil composition. In the present description, the pour point means the pour point measured conforming to JIS K 2269-1987.

The sulfur content in the base oil depends on the sulfur content in the raw material thereof. For example, when a substantially sulfur-free raw material such as synthetic wax components obtained through, for example, a Fischer-Tropsch reaction is used, a substantially sulfur-free base oil can be obtained; and when a sulfur-containing raw material such as a slack wax obtained through the process of refining the base oil, and a microwax obtained through a wax refining process is used, the sulfur content in the obtained base oil is normally no less than 100 mass ppm. The sulfur content in the lubricant base oil (total base oil) is normally no more than 0.03 mass %; and is preferably no more than 0.01 mass % in view of oxidation stability. In the present description, the sulfur content in the base oil means the sulfur content measured conforming to JIS K 2541-2003.

The lubricant base oil may comprise a single base oil component, and may comprise a plurality of base oil components. In one preferred embodiment, the kinematic viscosity of the entire base oil (total base oil) at 40° C. can be no more than 40 $mm^2/s$.

In one embodiment, the lubricant base oil can comprise at least one API Group II base oil, at least one API Group III base oil, at least one API Group IV base oil, or at least one API Group V base oil, or any combination thereof in an amount of 80 to 100 mass %, or 90 to 100 mass %, or 90 to 99 mass %, or 95 to 99 mass % on the basis of the total mass of the base oil.

The content of the lubricant base oil (total base oil) in the lubricating oil composition on the basis of the total mass of the lubricating oil composition is no less than 60 mass %, preferably 60 to 98.5 mass %, and more preferably 70 to 98.5 mass %; and in one embodiment, can be 75 to 97 mass %.

((A) Lubricating Oil Additive Composition)

The lubricating oil composition according to the present invention comprises the aforementioned lubricating oil additive composition according to the first aspect of the present invention (hereinafter may be referred to as the "(A) component"). The lubricating oil additive composition according to the first aspect of the present invention functions as an oiliness agent-based friction modifier.

In one embodiment, the content of the (A) component in the lubricating oil composition on the basis of the total mass of the lubricating oil composition in terms of entire acylated compound obtained by acylating, with the monovalent fatty acid (a1), a compound having an alkanolamine structure where a hydroxy group may be etherified in a state of forming no salt is preferably no less than 0.005 mass %, or no less than 0.010 mass %, or no less than 0.030 mass %, or no less than 0.050 mass % in view of improving friction reducing performance, particularly friction reducing performance on metal surfaces of gears etc. that tend to receive heavy loads while suppressing deterioration in storage stability of the lubricating oil composition, and in view of improving fatigue resistance; is preferably no more than 10.0 mass %, or no more than 5.0 mass %, or no more than 4.0 mass %, or no more than 3.0 mass % in view of storage stability; and in one embodiment, can be 0.005 to 10.0 mass %, or 0.010 to 5.0 mass %, or 0.030 to 4.0 mass %, or 0.050 to 3.0 mass %.

In one embodiment, the content of the components (i) to (iv) in total in the lubricating oil composition on the basis of the total mass of the lubricating oil composition in terms of compound in a state of forming no salt is preferably no less than 0.005 mass %, or no less than 0.010 mass %, or no less than 0.030 mass %, or no less than 0.050 mass % in view of further improving friction reducing performance, particularly friction reducing performance on metal surfaces of gears etc. that tend to receive heavy loads while suppressing deterioration in storage stability of the lubricating oil composition, and in view of further improving fatigue resistance; is preferably no more than 10.0 mass %, or no more than 5.0 mass %, or no more than 4.0 mass %, or no more than 3.0 mass % in view of storage stability; and in one embodiment, can be 0.005 to 10.0 mass %, or 0.010 to 5.0 mass %, or 0.030 to 4.0 mass %, or 0.050 to 3.0 mass %.

In one embodiment, the content of the components (i) to (v) in total in the lubricating oil composition based on the basis of the total mass of the lubricating oil composition in terms of compound in a state of forming no salt is preferably no less than 0.005 mass %, or no less than 0.010 mass %, or no less than 0.030 mass %, or no less than 0.050 mass % in view of further improving friction reducing performance, particularly friction reducing performance on metal surfaces of gears etc. that tend to receive heavy loads while suppressing deterioration in storage stability of the lubricating oil composition, and in view of further improving fatigue resistance; is preferably no more than 10.0 mass %, or no more than 5.0 mass %, or no more than 4.0 mass %, or no more than 3.0 mass % in view of storage stability; and in one embodiment, can be 0.005 to 10.0 mass %, or 0.010 to 5.0 mass %, or 0.030 to 4.0 mass %, or 0.050 to 3.0 mass %.

((B): Metallic Detergent)

In one preferred embodiment, the lubricating oil composition may further comprise at least one metallic detergent (hereinafter may be referred to as the "(B) component"). Examples of the (B) component include salicylate detergents, sulfonate detergents, and phenate detergents. The (B) component may comprise one metallic detergent only, and may comprise at least two metallic detergents. Generally, in the lubricating oil field, organic acid metal bases that can form micelles in a base oil (such as alkali or alkaline earth metal alkylsalicylates, alkali or alkaline earth metal alkylbenzene sulfonates, and alkali or alkaline earth metal alkylphenates), or mixtures of such organic acid metal bases and basic metal salts (including hydroxides, carbonates and borates of alkali or alkaline earth metals constituting such organic acid metal bases) are used as a metallic detergent. Such an organic acid usually has, in a molecule thereof, at least one polar group that can form a salt along with a metal base (typically a metal oxide and/or metal hydroxide) and that has Broensted acidity (such as a carboxy group, a sulfo group, and a phenolic hydroxy group), and at least one lipophilic group such as a linear or branched chain alkyl group (for example, C6 or more linear or branched chain alkyl).

Examples of a salicylate detergent as used herein include metal salicylates, and basic or overbased salts thereof. A preferred example of a metal salicylate as used herein is the alkali or alkaline earth metal salicylate represented by the following general formula (26):

(26)

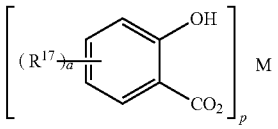

In the general formula (26), $R^{17}$'s each independently represent C14-30 alkyl or alkenyl; M represents an alkali metal or alkaline earth metal; a represents 1 or 2; and p represents 1 or 2 correspondingly to the valence of M. When M is an alkali metal, p is 1; and when M is an alkaline earth metal, p is 2. M is preferably an alkaline earth metal. Sodium or potassium is preferable as an alkali metal here. Calcium or magnesium is preferable as an alkaline earth metal here. As a, 1 is preferable. When a=2, $R^{17}$'s may be any combination of different groups.

One preferred form of the salicylate detergent is the alkaline earth metal salicylate of the general formula (26) where a=1, or a basic or overbased salt thereof.

A preferred example of a sulfonate detergent as used herein is an alkali or alkaline earth metal salt of an alkyl aromatic sulfonic acid obtained by sulfonation of an alkylaromatic, or a basic or overbased salt thereof; and a more preferred example thereof is an alkaline earth metal salt of the foregoing alkyl aromatic sulfonic acid, or a basic or overbased salt thereof. The weight average molecular weight of an alkylaromatic here is preferably 400 to 1500, and more preferably 700 to 1300.

Sodium or potassium is preferable as an alkali metal here. Calcium or magnesium is preferable as an alkaline earth metal here. Examples of an alkyl aromatic sulfonic acid here include what is called petroleum sulfonic acids and synthetic sulfonic acids. Examples of a petroleum sulfonic acid here include sulfonated products of alkylaromatics of lubricating oil fractions derived from a mineral oil, and what is called mahogany acid which is a side product of white oil. One example of a synthetic sulfonic acid here is a sulfonated product of an alkylbenzene having a linear or branched chain alkyl group: the sulfonated product is obtained by recovering side products in manufacturing plants of an alkylbenzene which is a raw material of detergent, or by alkylating benzene with a polyolefin. Another example of a synthetic sulfonic acid here is a sulfonated product of an alkylnaphthalene, such as dinonylnaphthalene. A sulfonating agent used when these alkylaromatics are sulfonated is not specifically limited, and for example, fuming sulfuric acid or sulfuric anhydride may be used.

Preferred examples of a phenate detergent as used herein include overbased salts of alkali or alkaline earth metal salts of compounds each having the structure represented by the following general formula (27); and more preferred examples thereof include overbased salts of alkaline earth metal salts of the foregoing compounds. Sodium or potassium is preferable as an alkali metal here. Calcium or magnesium is preferable as an alkaline earth metal here.

(27)

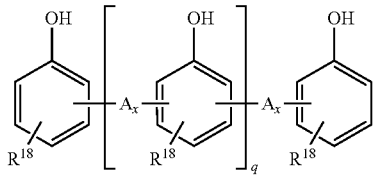

In the general formula (27), $R^{18}$'s are C6-21 linear or branched chain, saturated or unsaturated alkyl or alkenyl; q represents an integer of 0 to 9; A represents a sulfide (—S—) group or a methylene (—$CH_2$—) group; and x's represent integers of 1 to 3. $R^{18}$'s may be any combination of at least two different groups, and x's may be any combination of a plurality of different integers. When A is a methylene group, x's are preferably 1. An -$A_x$- group substituent in each aromatic ring is normally at the o-position or p-position, and typically at the o-position for the hydroxy group typically.

The carbon numbers of $R^{18}$'s in the general formula (27) are preferably no less than 9 in view of improving the solubility in the base oil; are preferably no more than 18, and more preferably no more than 15 in view of easy production; and in one embodiment, can be 9 to 18, or 9 to 15.

In the general formula (27), q is preferably 0 to 3.

The metallic detergent may be carbonate salt-overbased (examples of a carbonate salt here include alkali metal carbonate salts such as sodium carbonate and potassium carbonate, and alkaline earth metal carbonate salts such as calcium carbonate and magnesium carbonate), and may be borate salt-overbased (examples of a borate salt here include alkali metal borate salts such as sodium borate and potassium borate, and alkaline earth metal borate salts such as calcium borate and magnesium borate).

In one embodiment, the (B) component comprises at least one overbased calcium or magnesium sulfonate detergent, at least one overbased calcium or magnesium salicylate detergent, and/or at least one overbased calcium or magnesium phenate detergent, and can preferably comprise at least one overbased calcium sulfonate detergent, and/or at least one overbased calcium salicylate detergent. A calcium sulfonate detergent, a calcium salicylate detergent, and a calcium phenate detergent here are each preferably calcium carbonate-overbased; and a magnesium sulfonate detergent, a magnesium salicylate detergent, and a magnesium phenate detergent here are each preferably magnesium carbonate-overbased.

The base number of the metallic detergent can be determined appropriately according to the use of the lubricating oil composition. For example, when the lubricating oil composition is used for lubrication of gears of transmissions (such as manual transmissions, automatic transmissions, and continuously variable transmissions), the base number of the metallic detergent is preferably no less than 200 mgKOH/g, and more preferably no less than 250 mgKOH/g in view of improving anti-wear performance, anti-seizure performance, and the torque transmitting capacity of wet clutches; is preferably no more than 600 mgKOH/g, and more preferably no more than 550 mgKOH/g in the same view; and in one embodiment, can be 200 to 600 mgKOH/g, or 250 to 550 mgKOH/g. For example, when the lubricating oil composition is used for lubrication of internal combustion engines, the base number of the metallic detergent is preferably no less than 0 mgKOH/g, and more preferably no less than 20 mgKOH/g in view of improving detergency, and base number retention; is preferably no more than 500 mgKOH/g, and more preferably no more than 450 mgKOH/g in view of suppressing the ash content in the composition and in view of the lifetime of exhaust gas post treatment systems; and in one embodiment, can be 0 to 500 mgKOH/g, or 20 to 450 mgKOH/g. In this description, the base number means the base number measured conforming to JIS K2501 by a perchloric acid method.

When the lubricating oil composition comprises the (B) component, the content of the (B) component can be determined appropriately according to the use of the lubricating oil composition. For example, when the lubricating oil composition is used for lubrication of gears of transmissions (such as manual transmissions, automatic transmissions, and continuously variable transmissions), the content of the (B) component in the lubricating oil composition on the basis of the total mass of the lubricating oil composition in terms of metal is preferably no less than 200 mass ppm, and more preferably no less than 250 mass ppm in view of improving anti-wear performance, anti-seizure performance, fatigue resistance, and the torque transmitting capacity of wet clutches; is preferably no more than 600 mass ppm, and more preferably no more than 550 mass ppm in view of improving fuel efficiency, and fatigue resistance; and in one embodiment, can be 200 to 600 mass ppm, or 250 to 550 mass ppm. For example, when the lubricating oil composition is used for lubrication of internal combustion engines, the content of the (B) component on the basis of the total mass of the lubricating oil composition in terms of metal is preferably no less than 500 mass ppm, and more preferably no less than 1000 mass ppm in view of improving detergency, and base number retention; is preferably no more than 10000 mass ppm, and more preferably no more than 5000 mass ppm in view of suppressing the ash content in the composition and in view of the lifetime of exhaust gas post treatment systems; and in one embodiment, can be 500 to 10000 mass ppm, or 1000 to 5000 mass ppm.

((C) Nitrogen-Containing Dispersant)

In one preferred embodiment, the lubricating oil composition may further comprise at least one nitrogen-containing dispersant (hereinafter may be referred to as the "(C) component"). Generally, in the lubricating oil field, as a nitrogen-containing dispersant, nitrogen-containing compounds having, in each molecule, at least one linear or branched long-chain (for example, C40 or more) aliphatic hydrocarbon group, and at least one polyamine chain (typically polyethylene amine chain): a part of nitrogen atoms of the polyamine chain may be acylated; or modified products (derivatives) thereof are used. Examples of a modified product here will be described later.

An example of the (C) component is at least one compound selected from the following (C-1) to (C-3):

(C-1) a succinimide having at least one alkyl or alkenyl group in a molecule thereof, or a modified product (derivative) thereof (hereinafter may be referred to as the "component (C-1)");

(C-2) a benzylamine having at least one alkyl or alkenyl group in a molecule thereof (such as a Mannich base obtained by the reaction of an alkylphenol or alkenylphenol, formaldehyde, and a polyamine), or a modified product (derivative) thereof (hereinafter may be referred to as the "component (C-2)"); and (C-3) a N-alkylated or alkenylated polyamine having at least one alkyl or alkenyl group in a molecule thereof, or a modified product (derivative) thereof (hereinafter may be referred to as the "component (C-3)").

The component (C-1) can be especially preferably used as the (C) component.

An example of a succinimide having at least one alkyl or alkenyl group in a molecule thereof that falls under the component (C-1) is a condensation reaction product of an alkyl or alkenyl succinic acid having C40-400 alkyl or alkenyl, or an anhydride thereof with a polyamine. For example, such a condensation reaction product (condensation product) can be represented by the following general formula (28a) or (28b):

(28a)

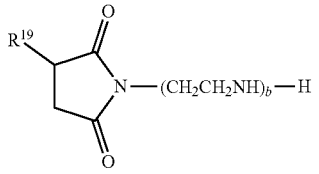

(28b)

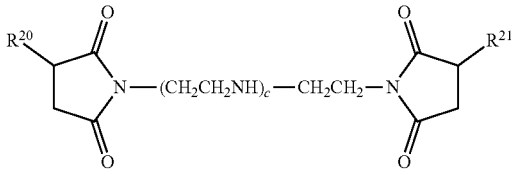

In the general formula (28a), $R^{19}$ represents C40-400 alkyl or alkenyl, and b represents an integer of 1 to 10, preferably 2 to 6. In one typical embodiment, the compound represented by the general formula (28a) is obtainable as a mixture of compounds having different b's. The carbon number of $R^{19}$ is no less than 40, and preferably no less than 60 in view of the solubility in the base oil; is no more than 400, preferably no more than 350, and further preferably no more than 250 in view of the low-temperature fluidity of the composition; and in one embodiment, can be 40 to 400, 60 to 350, or 60 to 250.

In the general formula (28b), $R^{20}$ and $R^{21}$ are each independently C40-400 alkyl or alkenyl, and may be any combination of different groups; and c is an integer of 0 to 15, preferably 1 to 13, more preferably 1 to 11. In one typical embodiment, the compound represented by the general formula (28b) is obtainable as a mixture of compounds having different c's. The carbon numbers of $R^{20}$ and $R^{21}$ are each no less than 40, and preferably no less than 60 in view of the solubility in the base oil; is no more than 400, preferably no more than 350, and further preferably no more than 250 in view of the low-temperature fluidity of the composition; and in one embodiment, can be 40 to 400, 60 to 350, or 60 to 250.

The alkyl or alkenyl groups ($R^{19}$ to $R^{21}$) in the general formulae (28a) and (28b) may be linear or branched; and preferred examples thereof include branched alkyl groups and branched alkenyl groups that are derived from oligomers of olefins such as propylene, 1-butene and isobutene, or co-oligomers of ethylene and propylene. Among them, a branched alkyl or alkenyl group derived from an oligomer of isobutene which is conventionally referred to as polyisobutylene, or a polybutenyl group is most preferable.

Suitable number average molecular weights of the alkyl or alkenyl groups ($R^{19}$ to $R^{21}$) in the general formulae (28a) and (28b) are 800 to 3500, and preferably 900 to 3500.

The succinimide having at least one alkyl or alkenyl group in a molecule thereof encompasses so-called monotype succinimide, which is represented by the general formula (28a) where only one terminal of the polyamine chain is imidated, and so-called bistype succinimide, which is represented by the general formula (28b) where both terminals of the polyamine chain are imidated. The lubricating oil composition may comprise either one of the monotype and bistype succinimides, and may comprise both thereof as a mixture. The content of the bistype succinimide or any modified products thereof in the component (C-1) is preferably 50 to 100 mass %, and more preferably 70 to 100 mass % on the basis of the total mass of the (C-1) component (100 mass %).

The weight average molecular weight of the component (C-1) is preferably 1000 to 20000, more preferably 2000 to 20000, and further preferably 3000 to 15000; and in one embodiment, can be 4000 to 15000.

Examples of a modified product (modified compound or derivative) in the components (C-1) to (C-3) include (i) oxygen-containing organic compound-modified products, (ii) boric acid-modified products, (iii) phosphoric acid-modified products, (iv) sulfur-modified products, and (v) modified products of at least two thereof in combination.

The (i) oxygen-containing organic compound-modified product is a modified compound where a part or all of the residual amino groups and/or imino groups is/are neutralized or amidated by reacting a C1-30 monocarboxylic acid such as fatty acids, a C2-30 polycarboxylic acid (such as ethanedioic acid, phthalic acid, trimellitic acid, and pyromellitic acid), an anhydride or ester thereof, a C2-6 alkylene oxide, or a hydroxy(poly)oxyalkylene carbonate with the aforementioned succinimide having at least one alkyl or alkenyl group in a molecule thereof, benzylamine or polyamine (hereinafter referred to as the "aforementioned nitrogen-containing compound").

The (ii) boric acid-modified product is a modified compound where a part or all of the residual amino groups and/or imino groups is/are neutralized or amidated by reacting boric acid with the aforementioned nitrogen-containing compound.

The (iii) phosphoric acid-modified product is a modified compound where a part or all of the residual amino groups and/or imino groups is/are neutralized or amidated by reacting the aforementioned nitrogen-containing compound with phosphoric acid.

The (iv) sulfur-modified product is a modified compound obtained by reacting a sulfur compound with the aforementioned nitrogen-containing compound.

The (v) modified product of at least two thereof in combination can be obtained by subjecting the aforementioned nitrogen-containing compound to at least two modifications selected from oxygen-containing organic compound modification, boron modification, phosphoric acid modification, and sulfur modification in combination.

Among these modified products (derivatives) (i) to (v), a boric acid-modified compound of an alkenyl succinimide, especially a boric acid-modified product of a bistype alkenyl succinimide can be preferably used.

When the lubricating oil composition comprises the (C) component, the content of the (C) component can be determined appropriately according to the use of the lubricating oil composition. For example, when the lubricating oil composition is used for lubrication of gears of transmissions (such as manual transmissions, automatic transmissions, and continuously variable transmissions), the content of the (C) component in the lubricating oil composition on the basis of the total mass of the lubricating oil composition is preferably no less than 0.1 mass % in view of improving oxidation stability; and is preferably no more than 10 mass %, and more preferably no more than 5 mass % in view of maintaining energy saving performance. For example, when the lubricating oil composition is used for lubrication of internal combustion engines, the content of the (C) component on the basis of the total mass of the lubricating oil composition is preferably no less than 0.5 mass %, and more preferably no less than 1.0 mass % in view of improving anti-coking properties; is preferably no more than 10.0 mass %, and more preferably no more than 5.0 mass % in view of maintaining fuel efficiency; and in one embodiment, can be 0.5 mass % to 10.0 mass %, or 1.0 mass % to 5.0 mass %.

As the (C) component, the (C-1) component can be preferably used, and as a modified product in the (C) component, a boric acid-modified product can be preferably used. In one embodiment, the (C) component may be at least one non-modified (C-1) component (non-modified succinimide dispersant), may be at least one boric acid-modified product of the (C-1) component (boric acid-modified succinimide dispersant), and may be any combination of at least one non-modified succinimide dispersant and at least one boric acid-modified succinimide dispersant. The (C) component may optionally comprise a boric acid-modified product. In view of sludge dispersancy, the ratio (B/N) of the content B as the boron content of the (C) component to the content N as the nitrogen content of the (C) component can be preferably 0 to 1.0 in one embodiment.

((D) Phosphorus-Containing Anti-Wear Agent>

In one preferred embodiment, the lubricating oil composition may comprise at least one phosphorus-containing anti-wear agent (hereinafter may be referred to as the "(D) component"). A phosphorus-containing anti-wear agent that is used for a lubricating oil may be used as the (D) component without specific limitations. Examples of a phosphorus-containing anti-wear agent as used herein include the compound represented by the following general formula (29), the compound represented by the following general formula (30), and metal salts and ammonium salts thereof.

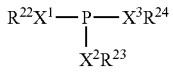

(29)

(in the general formula (29), $X^1$, $X^2$ and $X^3$ each independently represent an oxygen atom or a sulfur atom; $R^{22}$ represents C1-30 hydrocarbon that may have a sulfur atom; $R^{23}$ and $R^{24}$ each independently represent C1-30 hydrocarbon that may have a sulfur atom, or represent a hydrogen atom; and $R^{22}$, $R^{23}$ and $R^{24}$ may be the same, and may be different from each other. When $R^{23}$ and/or $R^{24}$ is/are (a) hydrogen atom(s), the compound of the general formula (29) shall encompass any tautomers thereof.)

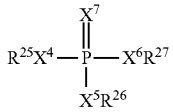

(30)

(In the general formula (30), $X^4$, $X^5$, $X^6$ and $X^7$ each independently represent an oxygen atom or a sulfur atom; $R^{25}$ represents C1-30 hydrocarbon that may have a sulfur atom; $R^{26}$ and $R^{27}$ each independently represent C1-30 hydrocarbon that may have a sulfur atom, or represent a hydrogen atom; and $R^{25}$, $R^{26}$ and $R^{27}$ may be the same, and may be different from each other.)

Examples of C1-30 hydrocarbon in the general formulae (29) and (30) include alkyl groups, cycloalkyl groups, alkenyl groups, alkyl-substituted cycloalkyl groups, aryl groups, alkyl-substituted aryl groups, and arylalkyl groups. This hydrocarbon group is preferably C1-30 alkyl or C6-24 aryl; and in one embodiment, is C3-18, further preferably C4-12 alkyl, aryl, or arylalkyl.

The C1-30 hydrocarbon in the general formulae (29) and (30) each may be a hydrocarbon group having a sulfur atom, and may be a hydrocarbon group having no sulfur atom.

In one embodiment, a preferred example of a hydrocarbon group having no sulfur atom here is C4-18 linear chain alkyl. Examples of C4-18 linear chain alkyl here include a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, and an octadecyl group.

Examples of a hydrocarbon group having a sulfur atom here include hydrocarbon groups functionalized by sulfide bonds. Preferred examples of a hydrocarbon group functionalized by sulfide bonds here include the C4-20 group represented by the following general formula (31):

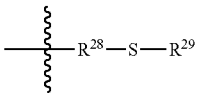

(31)

In the general formula (31), $R^{28}$ is C2-17 linear chain hydrocarbon, preferably an ethylene group or a propylene group; and in one embodiment, is an ethylene group. $R^{29}$ is C2-17 linear chain hydrocarbon, preferably C2-16 linear chain hydrocarbon, and especially preferably C6-10 linear chain hydrocarbon.

Preferred examples of the group represented by the general formula (31) include a 3-thiapentyl group, a 3-thiahexyl group, a 3-thiaheptyl group, a 3-thiaoctyl group, a 3-thianonyl group, a 3-thiadecyl group, a 3-thiaundecyl group, and a 4-thiahexyl group.

Examples of a metal constituting a metal salt along with the phosphorus compound represented by the general formula (29) or (30) include alkali metals such as lithium, sodium, potassium and cesium, alkaline earth metals such as calcium, magnesium and barium, and transition metals such as zinc, copper, iron, lead, nickel, silver, and manganese. Among them, an alkaline earth metal such as calcium and magnesium, or zinc, or any combination thereof is preferable.

Examples of a nitrogen-containing compound constituting an ammonium salt along with the phosphorus compound represented by the general formula (29) or (30) include ammonia, monoamines, diamines, polyamines and alkanolamines; and more specific examples thereof include the nitrogen-containing compound represented by the following general formula (32); alkylene diamine such as methylenediamine, ethylenediamine, propylenediamine, and butylenediamine; polyamines such as diethylenetriamine, triethylenetetramine, tetraethylenepentamine, and pentaethylenehexamine; and combinations thereof.

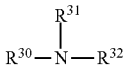

(32)

(In the general formula (32), $R^{30}$ to $R^{32}$ each independently represent a hydrogen atom, C1-8 hydrocarbyl, or C1-8 hydrocarbyl having a hydroxy group; and at least one of $R^{30}$ to $R^{32}$ is $C_{1-8}$ hydrocarbyl, or C1-8 hydrocarbyl having a hydroxy group.)

Preferred examples of the compound represented by the general formula (29) include: the phosphite ester compound of the general formula (29) where $X^1$ to $X^3$ are oxygen atoms, $R^{22}$ to $R^{24}$ are each independently C3-18 (preferably C4-12) alkyl, aryl (such as phenyl), or alkylaryl (such as alkylphenyl) that may have a sulfur atom; the hydrogen phosphite compound of the general formula (29) where $X^1$ to $X^3$ are oxygen atoms, $R^{22}$ and $R^{23}$ are each independently C3-18 (preferably C4-12) alkyl, aryl (such as phenyl), or alkylaryl (such as alkylphenyl) that may have a sulfur atom, and $R^{24}$ is hydrogen; the hydrogen thiophisphite compound of the general formula (29) where two of $X^1$ to $X^3$ are oxygen atoms and the rest thereof is a sulfur atom, $R^{22}$ and $R^{23}$ are each independently C3-18 (preferably C4-12) alkyl, aryl (such as phenyl), or alkylaryl (such as alkylphenyl) that may have a sulfur atom, and $R^{24}$ is hydrogen; and the hydrogen dithiophosphite compound of the general formula (29) where one of $X^1$ to $X^3$ is an oxygen atom and the rest two thereof are sulfur atoms, $R^{22}$ and $R^{23}$ are each independently C3-18 (preferably C4-12) alkyl, aryl (such as phenyl), or alkylaryl (such as alkylphenyl) that may have a sulfur atom, and $R^{24}$ is hydrogen.

A preferred example of the compound represented by the general formula (30) is the dithiophosphate compound of the general formula (30) where two of $X^4$ to $X^7$ are sulfur atoms and the rest two thereof are oxygen atoms, and $R^{25}$ to $R^{27}$ are each independently C3-18 (preferably C4-12) alkyl, aryl, or alkylaryl that may have a sulfur atom.

One of these compounds may be used alone, or two or more of them may be used in combination.

One example of the (D) component is zinc dialkyldithiophosphate (ZnDTP). An example of zinc dialkyldithiophosphate as used herein is the compound represented by the following general formula (33):

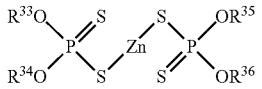

(33)

In the general formula (33), $R^{33}$ to $R^{36}$ each independently represent C3-18 linear or branched chain alkyl, and may be different groups in combination. The carbon numbers of $R^{33}$ to $R^{36}$ are preferably 3 to 12, and more preferably 3 to 8. $R^{33}$ to $R^{36}$ may be any of primary, secondary, and tertiary alkyl groups, and are preferably primary or secondary alkyl groups, or any combination thereof.

When the lubricating oil composition comprises the (D) component, the content of the (D) component can be determined appropriately according to the use of the lubricating oil composition. For example, when the lubricating oil composition is used for lubrication of gears of transmissions (such as manual transmissions, automatic transmissions, and continuously variable transmissions), the content of the (D) component in the lubricating oil composition on the basis of the total mass of the lubricating oil composition in terms of phosphorus is preferably no less than 50 mass ppm, and more preferably no less than 100 mass ppm in view of improving anti-wear performance, anti-seizure performance, the fatigue life of bearings, and shift shock prevention properties; is preferably no more than 800 mass ppm, and more preferably no more than 700 mass ppm in the same view; and in one embodiment, can be 50 to 800 mass ppm, or 100 to 700 mass ppm. For example, when the lubricating oil composition is used for lubrication of internal combustion engines, the content of the (D) component on the basis of the total mass of the lubricating oil composition in terms of phosphorus is preferably no less than 400 mass ppm, and more preferably no less than 500 mass ppm in view of improving anti-wear performance; is preferably no more than 5000 mass ppm, and more preferably no more than 3000 mass ppm in view of reducing catalyst poisoning in exhaust gas post treatment systems; and in one embodiment, can be 400 to 5000 mass ppm, or 500 to 3000 mass ppm.

((E) Sulfur-Containing Extreme-Pressure Agent)

In one preferred embodiment, the lubricating oil composition may further comprise at least one sulfur-containing extreme-pressure agent other than the (D) component (hereinafter may be referred to as the "(E) component"). Examples of the (E) component include known sulfur-containing extreme-pressure agents such as thiadiazole compounds, dihydrocarbyl (poly)sulfide, sulfurized fats and oils, sulfurized fatty acids, sulfurized esters, sulfurized olefins, alkylthiocarbamoyl compounds, thiocarbamate compounds, thioterpene compounds, dialkyl thiodipropionate compounds, sulfurized mineral oils, zinc dithiocarbamate compounds, and molybdenum dithiocarbamate compounds.

Preferred examples of a thiadiazole compound here include the 1,3,4-thiadiazole compound represented by the following general formula (34), the 1,2,4-thiadiazole compound represented by the following general formula (35), and the 1,2,3-thiadiazole compound represented by the following general formula (36):

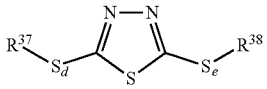

(34)

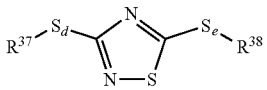

(35)

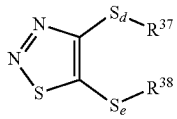

(36)

(in the general formulae (34) to (36), $R^{37}$ and $R^{38}$ may be the same, and may be different, and each independently represent a hydrogen atom, or C1-20 hydrocarbyl; and d and e may be the same, and may be different, and each independently represent an integer of 0 to 8).

Dihydrocarbyl (poly)sulfide here is the compound represented by the following general formula (37). Here, when $R^{39}$ and $R^{40}$ are alkyl groups, the compound may be referred to as an alkyl sulfide.

$$R^{39}—S_f—R^{40} \quad (37)$$

(In the general formula (37), $R^{39}$ and $R^{40}$ may be the same, and may be different, and each independently represent C1-20 alkyl (that may be a linear or branched chain, and may have a ring structure), C6-20 aryl, C7-20 alkylaryl, or C7-20 arylalkyl, and f represents an integer of 1 to 8.)

When the lubricating oil composition comprises the (E) component, the content of the (E) component can be determined appropriately according to the use of the lubricating oil composition. For example, when the lubricating oil composition is used for lubrication of gears of transmissions (such as manual transmissions, automatic transmissions, and continuously variable transmissions), the content of the (E) component in the lubricating oil composition on the basis of the total mass of the lubricating oil composition in terms of sulfur is preferably no less than 200 mass ppm, and more preferably no less than 300 mass ppm in view of improving extreme pressure performance and fatigue resistance; is preferably no more than 3000 mass ppm, and more preferably no more than 2500 mass ppm in view of improving anti-wear performance, fatigue resistance, and oxidation stability; and in one embodiment, can be 200 to 3000 mass ppm, or 300 to 2500 mass ppm. For example, when the lubricating oil composition is used for lubrication of internal combustion engines, the content of the (E) component on the basis of the total mass of the lubricating oil composition in terms of sulfur is preferably no less than 10 mass ppm, and more preferably no less than 30 mass ppm in view of improving extreme pressure performance and fatigue resistance; is preferably no more than 200 mass ppm, and more preferably no more than 100 mass ppm in view of reducing catalyst poisoning in exhaust gas post treatment systems; and in one embodiment, can be 10 to 200 mass ppm, or 30 to 100 mass ppm.

((F) Antioxidant)

In one preferred embodiment, the lubricating oil composition can further comprise at least one amine antioxidant, and/or at least one phenol antioxidant as an antioxidant (hereinafter may be referred to as the "component (F)").

Examples of an amine antioxidant as used herein include aromatic amine antioxidants and hindered amine antioxidants. Examples of an aromatic amine antioxidant here include primary aromatic amine compounds such as alkylated-α-naphthylamine; and secondary aromatic amine compounds such as alkylated diphenylamine, phenyl-α-naphthylamine, alkylated phenyl-α-naphthylamine, and phenyl-β-naphthylamine. As an aromatic amine antioxidant here, alkylated diphenylamine, or alkylated phenyl-α-naphthylamine, or any combination thereof may be preferably used.

Examples of a hindered amine antioxidant here include compounds each having a 2,2,6,6-tetraalkylpiperidine skeleton (2,2,6,6-tetraalkylpiperidine derivatives). As a 2,2,6,6-tetraalkylpiperidine derivative here, a 2,2,6,6-tetraalkylpiperidine derivative having a substituent at the 4-position is preferable. Two 2,2,6,6-tetraalkylpiperidine skeletons may be bonded with each other via the substituents at the 4-positions thereof. A 2,2,6,6-tetraalkylpiperidine skeleton as used herein may have no substituent at the N-position thereof, and may have a substituent of C1-4 alkyl at the N-position thereof. The 2,2,6,6-tetraalkylpiperidine skeleton is preferably a 2,2,6,6-tetramethylpiperidine skeleton.

Examples of a substituent at the 4-position of the 2,2,6,6-tetraalkylpiperidine skeleton as used herein include acyloxy groups ($R^{41}COO$—), alkoxy groups ($R^{41}O$—), alkylamino groups ($R^{41}NH$—), and acylamino groups ($R^{41}CONH$—). $R^{41}$ is preferably C1-30, more preferably C1-24, and further preferably C1-20 hydrocarbon. Examples of such a hydrocarbon group include alkyl groups, alkenyl groups, cycloalkyl groups, alkylcycloalkyl groups, aryl groups, alkylaryl groups, and arylalkyl groups.

When two 2,2,6,6-tetraalkylpiperidine skeletons are bonded with each other via the substituents at the 4-positions thereof, examples of the substituents include hydrocarbylene bis(carbonyloxy) groups (—OOC—$R^{42}$—COO—), hydrocarbylene diamino groups (—HN—$R^{42}$—NH—), and hydrocarbylene bis(carbonylamino) groups (—HNCO—$R^{42}$—CONH—). $R^{42}$ is preferably C1-30 hydrocarbylene, more preferably alkylene.

An acyloxy group is preferable as the substituent at the 4-position of the 2,2,6,6-tetraalkylpiperidine skeleton. One example of a compound having an acyloxy group at the 4-position of the 2,2,6,6-tetraalkylpiperidine skeleton is an ester of 2,2,6,6-tetramethyl-4-piperidinol and a carboxylic acid. Examples of this carboxylic acid include C8-20 linear or branched chain aliphatic carboxylic acids.

Examples of a phenol antioxidant as used herein include hindered phenol compounds and bisphenol compounds such as: 4,4'-methylenebis(2,6-di-tert-butylphenol); 4,4'-bis(2,6-di-tert-butylphenol); 4,4'-bis(2-methyl-6-tert-butylphenol); 2,2'-methylenebis(4-ethyl-6-tert-butylphenol); 2,2'-methylenebis(4-methyl-6-tert-butylphenol); 4,4'-butylidenebis(3-methyl-6-tert-butylphenol); 4,4'-isopropylidenebis(2,6-di-tert-butylphenol); 2,2'-methylenebis(4-methyl-6-nonylphenol); 2,2'-isobutylidenebis(4,6-dimethylphenol); 2,2'-methylenebis(4-methyl-6-cyclohexylphenol); 2,6-di-tert-butyl-4-methylphenol; 2,6-di-tert-butyl-4-ethylphenol; 2,4-dimethyl-6-tert-butylphenol; 2,6-di-tert-butyl-4-(N,N'-dimethylamino methyl)phenol; 4,4'-thiobis(2-methyl-6-tert-butylphenol); 4,4'-thiobis(3-methyl-6-tert-butylphenol); 2,2'-thiobis(4-methyl-6-tert-butylphenol); bis(3-methyl-4-hydroxy-5-tert-butylbenzyl) sulfide; bis(3,5-di-tert-butyl-4-hydroxybenzyl) sulfide; 3-(3,5-di-tert-butyl-4-hydroxyphenyl)propionic acid esters; and 3-methyl-5-tert-butyl-4-hydroxyphenol fatty acid esters.

When the lubricating oil composition comprises the (F) component, the content of the (F) component can be determined appropriately according to the use of the lubricating oil composition. For example, when the lubricating oil composition is used for lubrication of gears of transmissions (such as manual transmissions, automatic transmissions, and continuously variable transmissions), the content of the (F) component in the lubricating oil composition on the basis of the total mass of the lubricating oil composition is preferably no less than 0.1 mass %, and more preferably no less than 0.2 mass % in view of improving thermo-oxidative stability; is preferably no more than 2.0 mass %, and more preferably no more than 1.0 mass % in the same view; and in one embodiment, can be 0.1 to 2.0 mass %, or 0.2 to 1.0 mass %. For example, when the lubricating oil composition is used for lubrication of internal combustion engines, the content of the (F) component in the lubricating oil composition on the basis of the total mass of the lubricating oil composition is preferably no less than 0.1 mass %, and more preferably no less than 0.5 mass % in view of improving thermo-oxidative stability; is preferably no more than 5.0 mass %, and more preferably no more than 3.0 mass % in the same view; and in one embodiment, can be 0.1 to 5.0 mass %, or 0.5 to 3.0 mass %.

((G) Viscosity Index Improver)

In one preferred embodiment, the lubricating oil composition may further comprise at least one polymer having viscosity index improving effect (hereinafter may be referred to as the "viscosity index improver" or "(G) component"). Examples of the (G) component include non-dispersant or dispersant poly(meth)acrylates, (meth)acrylate-olefin copolymers, non-dispersant or dispersant ethylene-α-olefin copolymers or hydrogenated products thereof, polyisobutylene or hydrogenated products thereof, hydrogenated styrene-diene copolymers, styrene-maleic anhydride/ester copolymers, and polyalkylstyrene. In this description, "(meth)acrylate" means "acrylate and/or methacrylate". As the (G) component, one polymer may be used alone, and at least two polymers may be used in combination.

In one embodiment, as the (G) component, a dispersant poly(meth)acrylate, or a non-dispersant poly(meth)acrylate, or the combination thereof can be preferably used. In one embodiment, a dispersant poly(meth)acrylate can be preferably used. In this description, a dispersant poly(meth) acrylate compound has a functional group having a nitrogen atom, whereas a non-dispersant poly(meth)acrylate compound has no functional group having a nitrogen atom.

In one embodiment, as a poly(meth)acrylate-based viscosity index improver, a poly(meth)acrylate having 10 to 90 mol % structural unit represented by the following general formula (38) on the basis of the total monomer units in the polymer (hereinafter may be referred to as the "poly(meth) acrylate (G1)" or simply the "(G1) component") can be preferably used.

(38)

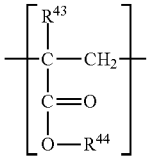

(In the general formula (38), $R^{43}$ represents hydrogen or a methyl group, and $R^{44}$ represents C1-36 linear or branched chain hydrocarbon, preferably alkyl.)

The weight-average molecular weight of the (G) component can be determined appropriately according to the use of the lubricating oil composition. For example, when the lubricating oil composition is used for lubrication of gears of transmissions (such as manual transmissions, automatic transmissions, and continuously variable transmissions), the weight-average molecular weight of the (G) component is preferably no less than 10,000, more preferably no less than 20,000, and further preferably no less than 30,000 in view of enhancing viscosity index improving effect to improve low-temperature viscosity characteristics; is preferably no more than 200,000, more preferably no more than 150,000, and further preferably no more than 100,000 in view of improving the solubility in the base oil, storage stability, and shear stability; and in one embodiment, can be 10,000 to 200,000, or 20,000 to 150,000, or 30,000 to 100,000. For example, when the lubricating oil composition is used for lubrication of internal combustion engines, the weight-average molecular weight of the (G) component is preferably no less than 100,000, and more preferably no less than 200,000 in view of enhancing viscosity index improving effect to improve low-temperature viscosity characteristics and fuel efficiency; is preferably no more than 1,000,000, and more preferably no more than 700,000 in view of improving solubility in oil, storage stability, and shear stability; and in one embodiment, can be 100,000 to 1,000,000, or 200,000 to 700,000.

When the lubricating oil composition comprises the (G) component, the content of the (G) component can be determined appropriately as a content such that desired kinematic viscosity and viscosity-temperature characteristics are obtained as the entire lubricating oil composition. For example, the viscosity index is the index with which viscosity-temperature characteristics are evaluated. For example, when the lubricating oil composition is used for lubrication of gears of transmissions (such as manual transmissions, automatic transmissions, and continuously variable transmissions), the content of the (G) component in the lubricating oil composition on the basis of the total mass of the lubricating oil composition as a resin content is, for example, no less than 0.1 mass %, or no less than 0.5 mass % in view of improving viscosity-temperature characteristics to improve energy saving performance; is, for example, no more than 22 mass %, or no more than 12 mass % in view of improving shear stability; and in one embodiment, can be 0.1 to 22 mass %, or 0.5 to 12 mass %. For example, when the lubricating oil composition is used for lubrication of internal combustion engines, the content of the (G) component in the lubricating oil composition on the basis of the total mass of the lubricating oil composition as a resin content is, for example, no less than 0.1 mass %, or no less than 0.5 mass % in view of improving fuel efficiency; is, for example, no more than 20 mass %, or no more than 15 mass % in view of improving shear stability; and in one embodiment, can be 0.1 to 20 mass %, or 0.5 to 15 mass %. In this description, the resin content means a polymer component having a molecular weight of no less than 1,000.

(Other Additives)

The lubricating oil composition according to the present invention can further comprise at least one additive selected from (H) a friction modifier other than the (A) and (E) components, (I) a pour point depressant other than the (G) component, (J) a corrosion inhibitor other than the (E) component, (K) a metal deactivator other than the (E) component, (L) an anti-rust agent other than the (A) component, (M) a demulsifier, (N) a defoaming agent, and (O) a coloring agent.

As the (H) friction modifier other than the (A) and (E) components (hereinafter may be referred to as the "(H) component"), an oil-soluble organic molybdenum compound or an oiliness agent-based friction modifier that is used as a friction modifier in a lubricating oil, and that is other than the (A) and (E) components can be used. Examples of such a compound include oil-soluble organic molybdenum compounds other than molybdenum dithiocarbamate described above as an example of the (E) component, and oiliness agent-based friction modifiers other than the (A) component.

When the lubricating oil composition comprises the (H) component, the content of the (H) component can be, for example, 0.1 to 1.0 mass % on the basis of the total mass of the lubricating oil composition.

As the (I) pour point depressant other than the (G) component (hereinafter may be referred to as the "(I) component"), for example, a known pour point depressant such as ethylene-vinyl acetate can be used according to the properties of the lubricant base oil to be used. When the lubricating oil composition comprises the (I) component, the content of the (I) component can be, for example, 0.01 to 1.0 mass % on the basis of the total mass of the lubricating oil composition.

As the (J) corrosion inhibitor other than the (E) component (hereinafter may be referred to as the "(J) component"), for example, a known corrosion inhibitor such as benzotriazole compounds, tolyltriazole compounds, and imidazole compounds can be used. When the lubricating oil composition comprises the (J) component, the content of the (J) component can be, for example, 0.005 to 5.0 mass % on the basis of the total mass of the lubricating oil composition.

As the (K) metal deactivator other than the (E) component (hereinafter may be referred to as the "(K) component"), for example, a known metal deactivator such as imidazolines, pyrimidine derivatives, mercaptobenzothiazoles, benzotriazoles and derivatives thereof, 2-(alkyldithio)benzimidazole, and β-(o-carboxybenzylthio)propionitrile can be used. When the lubricating oil composition comprises the (K) component, the content of the (K) component can be, for example, 0.005 to 1.0 mass % on the basis of the total mass of the lubricating oil composition.

As the (L) anti-rust agent other than the (A) component (hereinafter may be referred to as the "(L) component"), for example, a known anti-rust agent such as petroleum sulfonate, alkylbenzenesulfonate, dinonylnaphthalenesulfonate, alkenylsuccinate esters, and polyol esters (excluding those which fall under the (A) component) can be used. When the lubricating oil composition comprises the (L) component, the content of the (L) component can be, for example, 0.005 to 5.0 mass % on the basis of the total mass of the lubricating oil composition.

As the (M) demulsifier, for example, a known demulsifier such as polyalkylene glycol nonionic surfactants can be used. When the lubricating oil composition comprises the demulsifier, the content of the demulsifier can be, for example, 0.005 to 5.0 mass % on the basis of the total mass of the lubricating oil composition.

As the (N) defoaming agent, a known defoaming agent such as silicones, fluorosilicones, and fluoroalkyl ethers can be used. When the lubricating oil composition comprises the defoaming agent, the content of the defoaming agent can be, for example, 0.0005 to 1.0 mass % on the basis of the total mass of the lubricating oil composition.

As the (O) coloring agent, for example, a known coloring agent such as azo compounds can be used.

(Properties of Lubricating Oil Composition)

The kinematic viscosity of the lubricating oil composition at 100° C. can be determined appropriately according to the use of the lubricating oil composition. For example, when the lubricating oil composition is used for lubrication of gears of transmissions (such as manual transmissions, automatic transmissions, and continuously variable transmissions), the kinematic viscosity of the lubricating oil composition at 100° C. is preferably no less than 1.0 $mm^2/s$, and more preferably no less than 2.5 $mm^2/s$ in view of improving anti-wear performance; is preferably no more than 10.0 $mm^2/s$, and more preferably no more than 7.0 $mm^2/s$ in view of improving energy saving performance; and in one embodiment, can be 1.0 to 10.0 $mm^2/s$, or 1.0 to 7.0 $mm^2/s$, or 2.5 to 10.0 $mm^2/s$, or 2.5 to 7.0 $mm^2/s$. For example, when the lubricating oil composition is used for lubrication of internal combustion engines, the kinematic viscosity of the lubricating oil composition at 100° C. is preferably no less than 2.0 $mm^2/s$, and more preferably no less than 4.0 $mm^2/s$ in view of improving anti-wear performance; is preferably no more than 12.5 $mm^2/s$, and more preferably no more than 9.3 $mm^2/s$ in view of improving energy saving performance; and in one embodiment, can be 2.0 to 12.5 $mm^2/s$, or 4.0 to 12.5 $mm^2/s$, or 2.0 to 9.3 $mm^2/s$, or 4.0 to 9.3 $mm^2/s$.

The kinematic viscosity of the lubricating oil composition at 40° C. can be determined appropriately according to the use of the lubricating oil composition. For example, when the lubricating oil composition is used for lubrication of gears of transmissions (such as manual transmissions, automatic transmissions, and continuously variable transmissions), the kinematic viscosity of the lubricating oil composition at 40° C. is preferably no less than 5.0 $mm^2/s$, and more preferably no less than 8.0 $mm^2/s$ in view of improving anti-wear performance; is preferably no more than 50 $mm^2/s$, and more preferably no more than 45 $mm^2/s$ in view of improving energy saving performance; and in one embodiment, can be 5.0 to 50 $mm^2/s$, or 5.0 to 45 $mm^2/s$, or 8.0 to 50 $mm^2/s$, or 8.0 to 45 $mm^2/s$. For example, when the lubricating oil composition is used for lubrication of internal combustion engines, the kinematic viscosity of the lubricating oil composition at 40° C. is preferably no less than 4.0 $mm^2/s$, and more preferably no less than 6.0 $mm^2/s$ in view of improving anti-wear performance; is preferably no more than 50 $mm^2/s$, and more preferably no more than 35 $mm^2/s$ in view of improving energy saving performance; and in one embodiment, can be 4.0 to 50 $mm^2/s$, or 6.0 to 50 $mm^2/s$, or 4.0 to 35 $mm^2/s$, or 6.0 to 35 $mm^2/s$.

The viscosity index of the lubricating oil composition is preferably no less than 100, and more preferably no less than 110 in view of further improving energy saving performance and anti-wear performance; and in one embodiment, can be no less than 115, or no less than 120.

(Use)

The additive composition and the lubricating oil composition according to the present invention can be widely used in the lubrication field. The additive composition according to the present invention has improved friction reducing performance, and in particular, an improved friction reducing effect in a mixed lubrication regime (for example, lubricating conditions for gears) while the solubility in a base oil is maintained. The lubricating oil composition according to the present invention comprises the (A) component, whereby the friction reducing performance, in particular, friction reducing effect in a mixed lubrication regime (for example, lubricating conditions for gears) is improved while storage stability is maintained. The additive composition and the lubricating oil composition according to the present invention exert an improved friction reducing effect in lubrication on metal surfaces of gears etc. that tend to receive heavy loads, and thus, can be suitably used for lubrication of various types of machinery including with metal surfaces that tend to receive heavy loads, such as gear mechanisms, pistons, and connecting rod bearings; can be preferably used particularly for lubrication of transmissions (such as manual transmissions, automatic transmissions, continuously variable transmissions, reduction gears for electrically-propelled vehicles, and speed increasing gears for wind turbines), and internal combustion engines; and can be also preferably used for lubrication for various industrial uses (for example, hydraulic oils, turbine oils, and compressor oils).

EXAMPLES

Hereinafter the present invention will be further specifically described based on examples and comparative examples. The following examples are intended to illustrate, but not intended to limit the present invention.

Production Examples 1 to 5

Lubricating oil additive compositions having the compositions shown in tables 1 to 5 were produced by the undermentioned processes.

(Measurement Method)

Using FT/IR-4100 manufactured by JASCO Corporation, IR or infrared spectroscopy spectra of samples were measured by melting by heating the samples, and applying small amounts of the resultants onto KBr plates when the samples were solids at room temperature; and by applying small amounts of the samples onto KBr plates as they were when the samples were liquids at room temperature.

The contents of the components in the additive compositions were each measured by high performance liquid chromatography (HPLC). The measurement conditions for HPLC analysis were as follows:

[HPLC Measurement Conditions]

- device: UltiMate 3000 UHPLC manufactured by Thermo Fisher Scientific
- column: ACQUITY (registered trademark) UPLC BEH manufactured by Waters Corporation,
  C18: 1.7 μm, 50×2.1 mm (ODS)
- detector: charged aerosol detector (CAD) and mass spectrometry (MS) in combination charged aerosol detector (CAD): Corona (registered trademark) Veo (registered trademark) RS manufactured by Thermo Fisher Scientific, drying tube temperature: 35° C. mass spectrometry (MS): JMS-T100LP AccuTOF (registered trademark) LC-plus 4G manufactured by JEOL Ltd. (ionization: ESI+)
- mobile phase: gradient elution using ultrapure water, methanol, and isopropyl alcohol was used. Ammonium formate was added to each solvent so as to be 10 mmol/L in concentration. The composition had a water/methanol mixing volume ratio of 20/80 at the start timing, was consecutively changed to have 100% methanol, and thereafter, was further changed consecutively to have 100% isopropyl alcohol.
- column temperature: 40° C.
- sample solution: methanol solution having a sample concentration of approximately 100 mass ppm sample injection volume: 1.0 μL Based on the detection results of the mass spectrometry (MS), each detected peak of the charged aerosol detector (CAD) was assigned to a compound. The content of each of the components (mass % in terms of compound in a state of forming no salt) was quantitatively measured by using the peak area values of CAD. When one detected peak of CAD included a plurality of compounds, the content of each of the components (mass % in terms of compound in a state of forming no salt) was calculated by proportionally dividing the area value of the detected peak of CAD according to the ratio of the peak area values of MS as for these plural compounds.

Production Example 1

To a 5 L three-neck flask equipped with a distillation tube, 5.0 mol of lauric acid, and 7.5 mol of diethanolamine (hereinafter may be referred to as "DEA") were put along with a magnetic bar, nitrogen substitution was performed in the flask, and the substances in the flask were stirred with a magnetic stirrer to form a uniform mixture. The flask was heated in an oil bath while the mixture in the flask was stirred with the magnetic stirrer. The oil bath heating temperature was gradually raised so that water was continuously distilled out. The reaction was monitored with IR spectra, and in 24 hours, the completion of the reaction was confirmed from the IR spectra. The oil bath heating temperature at the time of the completion of the reaction was 180° C. The contents in the flask were allowed to cool, and dried in a reduced pressure whereby a crude product was obtained.

The obtained crude product was purified by preparative HPLC, whereby lubricating oil additive compositions 1a, 1b, 1c and 1d* having different composition ratios of each component were produced. The composition was analyzed by high performance liquid chromatography (LC/MS/CAD), and is shown in table 1. The compositions 1a, 1b and 1c were lubricating oil additive compositions according to the present invention, and the composition 1d* was a lubricating oil additive composition beyond the scope of the present invention.

TABLE 1

| | Components | | Additive compositions | | | |
|---|---|---|---|---|---|---|
| | | | 1a | 1b | 1c | 1d* |
| i | DEA dimer lauramide | mass % | 1 | 3 | 8 | 6 |
| | DEA trimer lauramide | mass % | 4 | 11 | 40 | 40 |
| ii | DEA monomer lauramide-esterification product | mass % | 91 | 70 | 12 | 4 |
| iii | DEA monomer lauramide | mass % | 2 | 14 | 22 | 32 |
| iv | DEA dimer lauramide-esterification product | mass % | 2 | 1 | 9 | 9 |
| | DEA trimer lauramide-esterification product | mass % | 0 | 1 | 9 | 9 |
| | total | mass % | 100 | 100 | 100 | 100 |
| | component (i) | mass % | 5 | 14 | 48 | 46 |
| | components (i) + (ii) | mass % | 96 | 84 | 60 | 50 |
| | components (iii) + (iv) | mass % | 4 | 16 | 40 | 50 |

Production Example 2

To a 5 L three-neck flask equipped with a distillation tube, 5.0 mol of oleic acid, and 7.5 mol of DEA were put along with a magnetic bar, nitrogen substitution was performed in the flask, and the substances in the flask were stirred with a magnetic stirrer to form a uniform mixture. The flask was heated in an oil bath while the mixture in the flask was stirred with the magnetic stirrer. The oil bath heating temperature was gradually raised so that water was continuously distilled out. The reaction was monitored with IR spectra, and in 24 hours, the completion of the reaction was confirmed from the IR spectra. The oil bath heating temperature at the time of the completion of the reaction was 180° C. The contents in the flask were allowed to cool, and dried in a reduced pressure whereby a crude product was obtained.

The obtained crude product was purified by preparative HPLC, whereby lubricating oil additive compositions 2a, 2b, 2c and 2d* having different composition ratios of each component were produced. The composition was analyzed by LC-MS, and is shown in table 2. The compositions 2a, 2b and 2c were lubricating oil additive compositions according to the present invention, and the composition 2d* was a lubricating oil additive composition beyond the scope of the present invention.

TABLE 2

| | Components | | Additive compositions | | | |
|---|---|---|---|---|---|---|
| | | | 2a | 2b | 2c | 2d* |
| i | DEA dimer oleamide | mass % | 1 | 6 | 10 | 8 |
| | DEA trimer oleamide | mass % | 4 | 13 | 42 | 41 |
| ii | DEA monomer oleamide-esterification product | mass % | 91 | 66 | 10 | 5 |
| iii | DEA monomer oleamide | mass % | 2 | 12 | 18 | 26 |
| iv | DEA dimer oleamide-esterification product | mass % | 2 | 1 | 11 | 10 |
| | DEA trimer oleamide-esterification product | mass % | 0 | 2 | 9 | 10 |
| | total | mass % | 100 | 100 | 100 | 100 |
| | component (i) | mass % | 5 | 19 | 52 | 49 |
| | components (i) + (ii) | mass % | 96 | 85 | 62 | 54 |
| | components (iii) + (iv) | mass % | 4 | 15 | 38 | 46 |

Production Example 3

To a 5 L three-neck flask equipped with a distillation tube, 5.0 mol of 2-decyltetradecanoic acid (branched chain fatty acid of the general formula (4) where k=0, $R^6$ was a dodecyl group, $R^7$ was a decyl group, and $R^8$ was a hydrogen atom), and 7.5 mol of DEA were put along with a magnetic bar, nitrogen substitution was performed in the flask, and the substances in the flask were stirred with a magnetic stirrer to form a uniform mixture. The flask was heated in an oil bath while the mixture in the flask was stirred with the magnetic stirrer. The oil bath heating temperature was gradually raised so that water was continuously distilled out. The reaction was monitored with IR spectra, and in 24 hours, the completion of the reaction was confirmed from the IR spectra. The oil bath heating temperature at the time of the completion of the reaction was 180° C. The contents in the flask were allowed to cool, and dried in a reduced pressure whereby a crude product was obtained.

The obtained crude product was purified by preparative HPLC, whereby lubricating oil additive compositions 3a, 3b, 3c and 3d* having different composition ratios of each component were produced. The composition was analyzed by LC-MS, and is shown in table 3. The compositions 3a, 3b and 3c were lubricating oil additive compositions according to the present invention, and the composition 3d* was a lubricating oil additive composition beyond the scope of the present invention.

TABLE 3

Table 3

| | Components | | Additive compositions 3a | 3b | 3c | 3d* |
|---|---|---|---|---|---|---|
| i | DEA dimer 2-decyltetradecanoic acid amide | mass % | 1 | 2 | 10 | 8 |
| | DEA trimer 2-decyltetradecanoic acid amide | mass % | 4 | 11 | 42 | 42 |
| ii | DEA monomer 2-decyltetradecanoic acid amide-esterification product | mass % | 89 | 71 | 10 | 5 |
| iii | DEA monomer 2-decyltetradecanoic acid amide | mass % | 3 | 15 | 21 | 32 |
| iv | DEA dimer 2-decyltetradecanoic acid amide-esterification product | mass % | 2 | 1 | 9 | 6 |
| | DEA trimer 2-decyltetradecanoic acid amide-esterification product | mass % | 1 | 0 | 8 | 7 |
| | total | mass % | 100 | 100 | 100 | 100 |
| | component (i) | mass % | 5 | 13 | 52 | 50 |
| | components (i) + (ii) | mass % | 94 | 84 | 62 | 55 |
| | components (iii) + (iv) | mass % | 6 | 16 | 38 | 45 |

Production Example 4

To a 5 L three-neck flask equipped with a distillation tube, 5.0 mol of 5,7,7-trimethyl-2-(1,3,3-trimethylbutyl)octanoic acid (branched chain fatty acid of the general formula (4) where k=0, $R^6$ was a 3,5,5-trimethylhexyl group, $R^7$ was a 1,3,3-trimethylbutyl group, and $R^8$ was a hydrogen atom, which hereinafter may be referred to as a "hyperbranched isostearic acid"), and 7.5 mol of DEA were put along with a magnetic bar, nitrogen substitution was performed in the flask, and the substances in the flask were stirred with a magnetic stirrer to form a uniform mixture. The flask was heated in an oil bath while the mixture in the flask was stirred with the magnetic stirrer. The oil bath heating temperature was gradually raised so that water was continuously distilled out. The reaction was monitored with IR spectra, and in 24 hours, the completion of the reaction was confirmed from the IR spectra. The oil bath heating temperature at the time of the completion of the reaction was 180° C. The contents in the flask were allowed to cool, and dried in a reduced pressure whereby a crude product was obtained.

The obtained crude product was purified by preparative HPLC, whereby lubricating oil additive compositions 4a, 4b, 4c, 4d and 4e* having different composition ratios of each component were produced. The composition was analyzed by LC-MS, and is shown in table 4. The compositions 4a, 4b, 4c and 4d were lubricating oil additive compositions according to the present invention, and the composition 4e* was a lubricating oil additive composition beyond the scope of the present invention.

TABLE 4

Table 4

| | Components | | Additive compositions 4a | 4b | 4c | 4d | 4e* |
|---|---|---|---|---|---|---|---|
| i | DEA dimer hyperbranched isostearic acid amide | mass % | 1 | 2 | 1 | 7 | 7 |
| | DEA trimer hyperbranched isostearic acid amide | mass % | 4 | 6 | 10 | 43 | 42 |
| ii | DEA monomer hyperbranched isostearic acid amide-esterification product | mass % | 90 | 82 | 73 | 10 | 5 |
| iii | DEA monomer hyperbranched isostearic acid amide | mass % | 4 | 9 | 15 | 20 | 27 |
| iv | DEA dimer hyperbranched isostearic acid amide-esterification product | mass % | 1 | 1 | 1 | 10 | 10 |
| | DEA trimer hyperbranched isostearic acid amide-esterification product | mass % | 0 | 0 | 0 | 10 | 9 |
| | total | mass % | 100 | 100 | 100 | 100 | 100 |
| | component (i) | mass % | 5 | 8 | 11 | 50 | 49 |
| | components (i) + (ii) | mass % | 95 | 90 | 84 | 60 | 54 |
| | components (iii) + (iv) | mass % | 5 | 10 | 16 | 40 | 46 |

Production Example 5

In production example 5, the processes described in the examples of patent literature 4 (WO 2019/129793 A1) were reproduced using available materials. To a 5 L three-neck flask equipped with a distillation tube, 2.5 mol of lauric acid, 2.5 mol of myristic acid, and 10.0 mol of DEA were put along with a magnetic bar, nitrogen substitution was performed in the flask, and the substances in the flask were stirred with a magnetic stirrer to form a uniform mixture. The flask was heated to 150° C. in an oil bath while the mixture in the flask was stirred with the magnetic stirrer, and the pressure in the flask was reduced with a rotary pump and the pressure in the system was kept at 20,000 Pa. After 10 hours had passed since the start of the reaction, the pressure in the system was further reduced to, and kept at 2,000 Pa After 24 hours had passed since the start of the reaction, the completion of the reaction was confirmed from IR spectra. The contents in the flask were allowed to cool, and dried in a reduced pressure, whereby a lubricating oil additive composition 5* was obtained as a mixture of condensation products.

The composition of the obtained mixture was analyzed by LC-MS, and was as shown in table 5. The composition 5 was a lubricating oil additive composition beyond the scope of the present invention.

TABLE 5

| | Components | | Additive composition 5* |
|---|---|---|---|
| i | DEA dimer lauramide | mass % | 20 |
| | DEA trimer lauramide | mass % | 13 |
| | DEA dimer myristamide | mass % | 10 |
| | DEA trimer myristamide | mass % | 7 |
| ii | DEA monomer lauramide-esterification product | mass % | 3 |
| | DEA monomer myristamide-esterification product | mass % | 2 |
| iii | DEA monomer lauramide | mass % | 23 |
| | DEA monomer myristamide | mass % | 12 |
| iv | DEA dimer lauramide-esterification product | mass % | 3 |
| | DEA trimer lauramide-esterification product | mass % | 3 |
| | DEA dimer myristamide-esterification product | mass % | 2 |
| | DEA trimer myristami de-esterification product | mass % | 2 |
| | total | mass % | 100 |
| | component (i) | mass % | 50 |
| | component (ii) | mass % | 5 |
| | components (i) + (ii) | mass % | 55 |
| | component (iii) | mass % | 35 |
| | component (iv) | mass % | 10 |
| | components (iii) + (iv) | mass % | 45 |

Examples 1 to 29 and Comparative Examples 1 to 9

As shown in tables 1 to 12, lubricating oil compositions according to the present invention (examples 1 to 29), and lubricating oil compositions for comparison (comparative examples 1 to 9) were each prepared. In the tables, "mass %" means mass % on the basis of the total mass of the lubricating oil composition (100 mass %). In addition, "mass ppm" means mass ppm on the basis of the total mass of the lubricating oil composition, and the expression "mass ppm/X" for an element X means mass ppm as the amount of the element X on the basis of the total mass of the lubricating oil composition. The details of each of the components were as follows.

(Lubricant Base Oil)

O-1: Group II base oil of API base stock categories (hydrocracked mineral base oil), kinematic viscosity (40° C.): 9.3 $mm^2/s$, kinematic viscosity (100° C.): 2.5 $mm^2/s$, viscosity index: 98, saturated content: 99.9%, sulfur content: less than 1 mass ppm O-2: Group V base oil of API base stock categories (bis(2-ethylhexyl) azelate), kinematic viscosity (40° C.): 11.0 $mm^2/s$, kinematic viscosity (100° C.): 3.1 $mm^2/s$, viscosity index: 146 [0195](Friction Modifier)

A-6*: oleic acid amide of a diethanolamine monomer

In the tables, 1a to 1c and 1d*, 2a to 2c and 2d*, 3a to 3c and 3d*, 4a to 4d and 4e*, and 5* are the lubricating oil additive compositions produced in production examples 1 to 5 (tables 1 to 5), respectively.

(Other Additives)

(B) metallic detergent: calcium salicylate detergent overbased with calcium carbonate, base number: 220 mgKOH/g, Ca: 8.1 mass %

(C) dispersant: boron-containing polybutenyl succinimide dispersant, N: 1.6 mass %, B: 0.35 mass %

(D) anti-wear agent: bis(3-thiaundecyl) hydrogen phosphite (E) extreme-pressure agent: thiadiazole compound, S: 36 mass %

(F) antioxidant: diphenylamine antioxidant (G) viscosity index improver: non-dispersant polymethacrylate, weight-average molecular weight: 35,000

(K) metal deactivator: triazole defoaming agent: dimethyl silicone

TABLE 6

Table 6

| | | Examples | | | | | Comparative example |
|---|---|---|---|---|---|---|---|
| | | 1 | 2 | 3 | 4 | 5 | 1 |
| lubricant base oil | | | | | | | |
| O-1 | | balance | balance | balance | balance | balance | balance |
| (A) friction modifier | | | | | | | |
| 1a | mass % | 0.50 | 3.00 | | | | |
| 1b | mass % | | | 0.50 | | | |
| 1c | mass % | | | | 0.50 | 0.06 | |
| (B) metallic detergent | mass % | 0.30 | 0.30 | 0.30 | 0.30 | 0.30 | 0.30 |
| (C) dispersant | mass % | 2.0 | 2.0 | 2.0 | 2.0 | 2.0 | 2.0 |
| (D) anti-wear agent | mass ppm/P | 350 | 350 | 350 | 350 | 350 | 350 |
| (E) extreme-pressure agent | mass % | 0.15 | 0.15 | 0.15 | 0.15 | 0.15 | 0.15 |
| (F) antioxidant | mass % | 0.5 | 0.5 | 0.5 | 0.5 | 0.5 | 0.5 |
| (G) viscosity index improver | mass % | 1.5 | 1.5 | 1.5 | 1.5 | 1.5 | 1.5 |
| (N) defoaming agent | mass % | 0.003 | 0.003 | 0.003 | 0.003 | 0.003 | 0.003 |
| properties of lubricating oil composition | | | | | | | |
| kinematic viscosity (40° C.) | $mm^2/s$ | 11.4 | 11.8 | 11.4 | 11.4 | 11.2 | 11.2 |
| kinematic viscosity (100° C.) | $mm^2/s$ | 3.0 | 3.0 | 3.0 | 3.0 | 2.9 | 2.9 |
| viscosity index | | 115 | 112 | 115 | 115 | 116 | 116 |
| MTM test | | | | | | | |
| μ reduction rate vs. comparative example 1 | % | 10 | 17 | 11 | 13 | 9 | base |
| storage stability | scale | 3 | 2 | 3 | 2 | 2 | 3 |
| fatigue life (Unisteel test) | | | | | | | |
| L50 improvement rate vs. comparative example 1 | % | 30 | 20 | 30 | 30 | 10 | base |

TABLE 7

Table 7

| | | Examples | | | | | Comparative example |
|---|---|---|---|---|---|---|---|
| | | 6 | 7 | 8 | 9 | 10 | 1 |
| lubricant base oil | | | | | | | |
| O-1 | | balance | balance | balance | balance | balance | balance |
| (A) friction modifier | | | | | | | |
| 2a | mass % | 0.50 | 3.00 | | | | |
| 2b | mass % | | | 0.50 | | | |
| 2c | mass % | | | | 0.50 | 0.06 | |
| (B) metallic detergent | mass % | 0.30 | 0.30 | 0.30 | 0.30 | 0.30 | 0.30 |
| (C) dispersant | mass % | 2.0 | 2.0 | 2.0 | 2.0 | 2.0 | 2.0 |
| (D) anti-wear agent | mass ppm/P | 350 | 350 | 350 | 350 | 350 | 350 |
| (E) extreme-pressure agent | mass % | 0.15 | 0.15 | 0.15 | 0.15 | 0.15 | 0.15 |
| (F) antioxidant | mass % | 0.5 | 0.5 | 0.5 | 0.5 | 0.5 | 0.5 |
| (G) viscosity index improver | mass % | 1.5 | 1.5 | 1.5 | 1.5 | 1.5 | 1.5 |
| (N) defoaming agent | mass % | 0.003 | 0.003 | 0.003 | 0.003 | 0.003 | 0.003 |
| properties of lubricating oil composition | | | | | | | |
| kinematic viscosity (40° C.) | $mm^2/s$ | 11.4 | 11.8 | 11.4 | 11.4 | 11.2 | 11.2 |
| kinematic viscosity (100° C.) | $mm^2/s$ | 3.0 | 3.0 | 3.0 | 3.0 | 2.9 | 2.9 |
| viscosity index | | 115 | 112 | 115 | 115 | 116 | 116 |
| MTM test | | | | | | | |
| μ reduction rate vs. comparative example 1 | % | 10 | 16 | 11 | 11 | 9 | base |
| storage stability | scale | 3 | 2 | 3 | 2 | 2 | 3 |
| fatigue life (Unisteel test) | | | | | | | |
| L50 improvement rate vs. comparative example 1 | % | 30 | 30 | 40 | 40 | 10 | base |

TABLE 8

Table 8

| | | Examples | | | | | Comparative example |
|---|---|---|---|---|---|---|---|
| | | 11 | 12 | 13 | 14 | 15 | 1 |
| lubricant base oil | | | | | | | |
| O-1 | | balance | balance | balance | balance | balance | balance |
| (A) friction modifier | | | | | | | |
| 3a | mass % | 0.50 | 3.00 | | | | |
| 3b | mass % | | | 0.50 | | | |
| 3c | mass % | | | | 0.50 | 0.06 | |
| (B) metallic detergent | mass % | 0.30 | 0.30 | 0.30 | 0.30 | 0.30 | 0.30 |
| (C) dispersant | mass % | 2.0 | 2.0 | 2.0 | 2.0 | 2.0 | 2.0 |
| (D) anti-wear agent | mass ppm/P | 350 | 350 | 350 | 350 | 350 | 350 |
| (E) extreme-pressure agent | mass % | 0.15 | 0.15 | 0.15 | 0.15 | 0.15 | 0.15 |
| (F) antioxidant | mass % | 0.5 | 0.5 | 0.5 | 0.5 | 0.5 | 0.5 |
| (G) viscosity index improver | mass % | 1.5 | 1.5 | 1.5 | 1.5 | 1.5 | 1.5 |
| (N) defoaming agent | mass % | 0.003 | 0.003 | 0.003 | 0.003 | 0.003 | 0.003 |
| properties of lubricating oil composition | | | | | | | |
| kinematic viscosity (40° C.) | $mm^2/s$ | 11.4 | 11.8 | 11.4 | 11.4 | 11.2 | 11.2 |
| kinematic viscosity (100° C.) | $mm^2/s$ | 3.0 | 3.0 | 3.0 | 3.0 | 2.9 | 2.9 |
| viscosity index | | 115 | 112 | 115 | 115 | 116 | 116 |
| MTM test | | | | | | | |
| μ reduction rate vs. comparative example 1 | % | 13 | 16 | 14 | 11 | 9 | base |
| storage stability | scale | 3 | 2 | 3 | 2 | 2 | 3 |
| fatigue life (Unisteel test) | | | | | | | |
| L50 improvement rate vs. comparative example 1 | % | 40 | 40 | 40 | 40 | 10 | base |

TABLE 9

Table 9

| | | Examples | | | | | | Comparative example |
|---|---|---|---|---|---|---|---|---|
| | | 16 | 17 | 18 | 19 | 20 | 21 | 1 |
| lubricant base oil | | | | | | | | |
| O-1 | | balance | balance | balance | balance | balance | balance | balance |
| (A) friction modifier | | | | | | | | |
| 4a | mass % | 0.50 | 3.00 | | | | | |
| 4b | mass % | | | 0.50 | | | | |
| 4c | mass % | | | | 0.50 | | | |
| 4d | mass % | | | | | 0.50 | 0.06 | |
| (B) metallic detergent | mass % | 0.30 | 0.30 | 0.30 | 0.30 | 0.30 | 0.30 | 0.30 |
| (C) dispersant | mass % | 2.0 | 2.0 | 2.0 | 2.0 | 2.0 | 2.0 | 2.0 |
| (D) anti-wear agent | mass ppm/P | 350 | 350 | 350 | 350 | 350 | 350 | 350 |
| (E) extreme-pressure agent | mass % | 0.15 | 0.15 | 0.15 | 0.15 | 0.15 | 0.15 | 0.15 |
| (F) antioxidant | mass % | 0.5 | 0.5 | 0.5 | 0.5 | 0.5 | 0.5 | 0.5 |
| (G) viscosity index improver | mass % | 1.5 | 1.5 | 1.5 | 1.5 | 1.5 | 1.5 | 1.5 |
| (N) defoaming agent | mass % | 0.003 | 0.003 | 0.003 | 0.003 | 0.003 | 0.003 | 0.003 |
| properties of lubricating oil composition | | | | | | | | |
| kinematic viscosity (40° C.) | $mm^2/s$ | 11.4 | 11.8 | 11.4 | 11.4 | 11.4 | 11.2 | 11.2 |
| kinematic viscosity (100° C.) | $mm^2/s$ | 3.0 | 3.0 | 3.0 | 3.0 | 3.0 | 2.9 | 2.9 |
| viscosity index | | 115 | 112 | 115 | 115 | 115 | 116 | 116 |
| MTM test | | | | | | | | |
| μ reduction rate vs. comparative example 1 | % | 11 | 17 | 12 | 16 | 12 | 9 | base |
| storage stability | scale | 3 | 2 | 3 | 3 | 2 | 2 | 3 |
| fatigue life (Unisteel test) | | | | | | | | |
| L50 improvement rate vs. comparative example 1 | % | 30 | 30 | 40 | 40 | 30 | 10 | base |

TABLE 10

Table 10

| | | Comparative examples | | | | | | |
|---|---|---|---|---|---|---|---|---|
| | | 1 | 4 | 5 | 6 | 7 | 8 | 9 |
| lubricant base oil | | | | | | | | |
| O-1 | | balance | balance | balance | balance | balance | balance | balance |
| (A) friction modifier | | | | | | | | |
| 1d* | mass % | | 0.50 | | | | | |
| 2d* | mass % | | | 0.50 | | | | |
| 3d* | mass % | | | | 0.50 | | | |
| 4e* | mass % | | | | | 0.50 | | |
| 5* | mass % | | | | | | 0.50 | |
| A-6* | mass % | | | | | | | 0.50 |
| (B) metallic detergent | mass % | 0.30 | 0.30 | 0.30 | 0.30 | 0.30 | 0.30 | 0.30 |
| (C) dispersant | mass % | 2.0 | 2.0 | 2.0 | 2.0 | 2.0 | 2.0 | 2.0 |
| (D) anti-wear agent | mass ppm/P | 350 | 350 | 350 | 350 | 350 | 350 | 350 |
| (E) extreme-pressure agent | mass % | 0.15 | 0.15 | 0.15 | 0.15 | 0.15 | 0.15 | 0.15 |
| (F) antioxidant | mass % | 0.5 | 0.5 | 0.5 | 0.5 | 0.5 | 0.5 | 0.5 |
| (G) viscosity index improver | mass % | 1.5 | 1.5 | 1.5 | 1.5 | 1.5 | 1.5 | 1.5 |
| (N) defoaming agent | mass % | 0.003 | 0.003 | 0.003 | 0.003 | 0.003 | 0.003 | 0.003 |
| properties of lubricating oil composition | | | | | | | | |
| kinematic viscosity (40° C.) | $mm^2/s$ | 11.2 | 11.4 | 11.4 | 11.4 | 11.4 | 11.4 | 11.4 |
| kinematic viscosity (100° C.) | $mm^2/s$ | 2.9 | 3.0 | 3.0 | 3.0 | 3.0 | 3.0 | 3.0 |
| viscosity index | | 116 | 115 | 115 | 115 | 115 | 115 | 115 |
| MTM test | | | | | | | | |
| μ reduction rate vs. comparative example 1 | % | base | 5 | 6 | 7 | 7 | 4 | 1 |
| storage stability | scale | 3 | 1 | 1 | 1 | 1 | 1 | 3 |
| fatigue life (Unisteel test) | | | | | | | | |
| L50 improvement rate vs. comparative example 1 | % | base | 0 | −10 | 10 | 10 | −10 | 0 |

TABLE 11

Table 11

| | | Examples | | | | Comparative example |
|---|---|---|---|---|---|---|
| | | 22 | 23 | 24 | 25 | 2 |
| lubricant base oil | | | | | | |
| O-2 | | balance | balance | balance | balance | balance |
| (A) friction modifier | | | | | | |
| 1b | mass % | 0.50 | | | | |
| 2b | mass % | | 0.50 | | | |
| 3b | mass % | | | 0.50 | | |
| 4c | mass % | | | | 0.50 | |
| (B) metallic detergent | mass % | 0.30 | 0.30 | 0.30 | 0.30 | 0.30 |
| (C) dispersant | mass % | 2.0 | 2.0 | 2.0 | 2.0 | 2.0 |
| (D) anti-wear agent | mass ppm/P | 350 | 350 | 350 | 350 | 350 |
| (E) extreme-pressure agent | mass % | 0.15 | 0.15 | 0.15 | 0.15 | 0.15 |
| (F) antioxidant | mass % | 0.5 | 0.5 | 0.5 | 0.5 | 0.5 |
| (G) viscosity index improver | mass % | 1.5 | 1.5 | 1.5 | 1.5 | 1.5 |
| (N) defoaming agent | mass % | 0.003 | 0.003 | 0.003 | 0.003 | 0.003 |
| properties of lubricating oil composition | | | | | | |
| kinematic viscosity (40° C.) | $mm^2/s$ | 15.6 | 15.6 | 15.6 | 15.6 | 15.4 |
| kinematic viscosity (100° C.) | $mm^2/s$ | 3.8 | 3.8 | 3.8 | 3.8 | 3.8 |
| viscosity index | | 141 | 141 | 141 | 141 | 143 |
| MTM test | | | | | | |
| μ reduction rate vs. comparative example 2 | % | 21 | 19 | 20 | 21 | base |
| storage stability | scale | 3 | 3 | 3 | 3 | 3 |
| fatigue life (Unisteel test) | | | | | | |
| L50 improvement rate vs. comparative example 2 | % | 30 | 30 | 30 | 30 | base |

TABLE 12

Table 12

| | | Examples | | | | Comparative example |
|---|---|---|---|---|---|---|
| | | 26 | 27 | 28 | 29 | 3 |
| lubricant base oil | | | | | | |
| O-1 | | balance | balance | balance | balance | balance |
| (A) friction modifier | | | | | | |
| 1b | mass % | 0.50 | | | | |
| 2b | mass % | | 0.50 | | | |
| 3b | mass % | | | 0.50 | | |
| 4c | mass % | | | | 0.50 | |
| (B) metallic detergent | mass % | — | — | — | — | — |
| (C) dispersant | mass % | — | — | — | — | — |
| (D) anti-wear agent | mass ppm/P | — | — | — | — | — |
| (E) extreme-pressure agent | mass % | — | — | — | — | — |
| (F) antioxidant | mass % | — | — | — | — | — |
| (G) viscosity index improver | mass % | — | — | — | — | — |
| (N) defoaming agent | mass % | — | — | — | — | — |
| properties of lubricating oil composition | | | | | | |
| kinematic viscosity (40° C.) | $mm^2/s$ | 9.4 | 9.4 | 9.4 | 9.4 | 9.3 |
| kinematic viscosity (100° C.) | $mm^2/s$ | 2.5 | 2.5 | 2.5 | 2.5 | 2.5 |
| viscosity index | | 97.0 | 97.0 | 97.0 | 97.0 | 98.0 |
| MTM test | | | | | | |
| μ reduction rate vs. comparative example 3 | % | 14 | 13 | 13 | 14 | base |
| storage stability | scale | 2 | 2 | 2 | 2 | 3 |
| fatigue life (Unisteel test) | | | | | | |
| L50 improvement rate vs. comparative example 3 | % | 80 | 80 | 80 | 80 | base |

A ball-on-disk friction test was carried out on each of the lubricating oil compositions by the use of a MTM traction machine (manufactured by PCS Instruments), and the friction coefficient (μ) under the conditions simulating lubrication of gears (in a mixed lubrication regime) was measured. The measurement conditions were as follows: ball and disk: standard test pieces (AISI 52100 standard)

oil temperature: 80° C.

load: 40 N speed: 0.3 m/s slip rate: 500

The results are shown in tables 6 to 12. In the tables, the friction coefficient reduction rates (%) of examples 1 to 21 and comparative examples 4 to 9 are shown compared to comparative example 1, the friction coefficient reduction rates (%) of examples 23 to 25 are shown compared to comparative example 2, and the friction coefficient reduction rates (%) of examples 26 to 29 are shown compared to comparative example 3.

(Storage Stability)

The state of each of the lubricating oil compositions after the prepared compositions were left standing at 70° C. for 10 hours was visually observed, whereby the storage stability was evaluated on a scale of 1 to 3. The composition states corresponding to the evaluation scale of 1 to 3 were as follows:

"3": the composition was transparent

"2": the composition was observed to be cloudy, but no generation of precipitates were observed therein "1": precipitates were generated in the composition The results are shown in tables 6 to 12. In this test, when the scale was 2 or the above, the composition had storage stability enough to be practically used. When the solubility of the lubricating oil additive in the base oil was insufficient, the storage stability of the lubricating oil composition comprising this additive was insufficient.

(Unisteel Test)

For each of the lubricating oil compositions, the rolling fatigue life of a ball bearing was measured by a Unisteel test (IP305/79, The Institute of Petroleum) using a Unisteel rolling fatigue testing machine (triple-type high-temperature rolling fatigue testing machine (TRF-1000/3-01H) manufactured by Tokyo Koki Testing Machine Co. Ltd.). For a test bearing made by replacing a bearing ring in one side of a ball bearing (51305 manufactured by NSK Ltd.) with a flat test piece (material: SUJ2), the time until either a ball or the test piece suffered fatigue damage was measured under the conditions of: 7000 N in load; 5.9 GPa in surface pressure; 1410 rpm in rotation speed; and 120° C. in oil temperature. Fatigue damage was determined to occur when the vibration acceleration of a testing portion measured by a vibration accelerometer installed in the Unisteel rolling fatigue testing machine reached 1.5 $m/s^2$. The fatigue life was calculated as the 50% life (L50: time it takes for the cumulative probability to be 50%) by a Weibull plot based on the time it had taken for fatigue damage to occur in the tests repeated ten times, and the improvement rate (%) to the comparison was calculated. The results are shown in tables 6 to 12. That the value of the improvement rate was 0 means the fatigue life was not improved compared to the comparison; and that the value of the improvement rate was a negative number means the fatigue life became worse than the comparison. The comparison in tables 6 to 10 was comparative example 1, the comparison in table 11 was comparative example 2, and the comparison in table 12 was comparative example 3. That the improvement rate in 50% life measured in this test was positively larger means fatigue resistance improving effect was greater.

(Evaluation Results)

Compared to the lubricating oil composition in comparative example 1 (tables 6 to 10), which comprised no oiliness agent-based friction modifier, the lubricating oil compositions in examples 1 to 21 (tables 6 to 9), which comprised lubricating oil additive compositions according to the present invention as oiliness agent-based friction modifiers, showed sufficient decrease in friction coefficient under the conditions simulating lubrication of gears, sufficient storage stability, and further, sufficient improvement in fatigue resistance.

The lubricating oil compositions in comparative examples 4 to 8 were the lubricating oil compositions to which the lubricating oil additive compositions 1d* (table 1), 2d* (table 2), 3d* (table 3), 4e* (table 4), and 5* (table 5), which were beyond the scope of the present invention, were incorporated, respectively, as oiliness agent-based friction modifiers instead of the lubricating oil additive composition according to the present invention. The lubricating oil composition in comparative example 8 was not enough to be practically used in storage stability, and moreover, showed the results inferior in friction coefficient reducing effect under the conditions simulating lubrication of gears, and also showed the results inferior in fatigue resistance.

The lubricating oil composition in comparative example 9 was the lubricating oil composition to which oleic acid amide of a diethanolamine monomer (amide compound of the general formula (18a) where $R^{13}$—CO— was an oleoyl group) was incorporated as an oiliness agent-based friction modifier instead of the lubricating oil additive composition according to the present invention. The lubricating oil composition in comparative example 9 showed good storage stability, but almost no friction coefficient reducing effect under the conditions simulating lubrication of gears, or no fatigue resistance improving effect.

The lubricating oil compositions in example 22 to 25 (table 11) were the lubricating oil compositions modified by substituting the base oil 0-2 (ester base oil, Group V base oil of API base stock categories) for the base oil 0-1 (hydrocracked mineral base oil, Group II base oil of API base stock categories) as the lubricant base oil in the lubricating oil compositions in examples 3, 8, 13 and 19, respectively. Compared to the lubricating oil composition in comparative example 2 (table 11), which comprised no oiliness agent-based friction modifier, the lubricating oil compositions in examples 22 to 25 showed sufficient decrease in friction coefficient under the conditions simulating lubrication of gears, sufficient storage stability, and further, sufficient improvement in fatigue resistance.

The lubricating oil compositions in examples 26 to 29 (table 12) were the modified compositions obtained by removing all the lubricating oil additives except the oiliness agent-based friction modifiers from the lubricating oil compositions in examples 3, 8, 13 and 19, respectively (that is, which were each formed of the base oil 0-1, and the oiliness agent-based friction modifier). Compared to the lubricating oil composition in comparative example 3 (table 12), which comprised no oiliness agent-based friction modifier, the lubricating oil compositions in examples 26 to 29 showed sufficient decrease in friction coefficient under the conditions simulating lubrication of gears, sufficient storage stability, and further, sufficient improvement in fatigue resistance.

The foregoing test results showed that according to the lubricating oil composition comprising the lubricating oil additive composition of the present invention, sufficient storage stability is obtained, and friction reducing performance, particularly friction reducing performance in a mixed lubrication regime (for example, lubrication of gears) can be improved, and further, fatigue resistance can be improved.

INDUSTRIAL APPLICABILITY

The additive composition and the lubricating oil composition according to the present invention can be widely used in the lubrication field. The additive composition according to the present invention has improved friction reducing performance, in particular, an improved friction reducing effect in a mixed lubrication regime (for example, lubricating conditions for gears), and further, improved fatigue resistance while the solubility in a base oil is maintained. The lubricating oil composition according to the present invention shows improved friction reducing performance, in particular, has an improved friction reducing effect in a mixed lubrication regime (for example, lubricating conditions for gears), and further, has improved fatigue resistance while the storage stability is maintained. The additive composition and the lubricating oil composition according to the present invention exert an improved friction reducing effect in lubrication on metal surfaces of gears etc. that tend to receive heavy loads, and fatigue resistance; thus, can be suitably used for lubrication of various types of machinery including metal surfaces that tend to receive heavy loads, such as gear mechanisms, pistons, and connecting rod bearings, can be preferably used particularly for lubrication of transmissions (such as manual transmissions, automatic transmissions, continuously variable transmissions, reduction gears for electrically-propelled vehicles, and speed increasing gears for wind turbines), and internal combustion engines, and can be also preferably used for lubrication for various industrial uses (for example, hydraulic oils, turbine oils, and compressor oils).

The invention claimed is:

1. A lubricating oil additive composition comprising:

(i) at least one first amide compound, and/or a salt thereof, the at least one first amide compound being a monoamide of at least one C6-30 linear or branched chain saturated or unsaturated monovalent fatty acid (a1), and at least one amine compound (a2), the monoamide having no ester bond, the amine compound (a2) being an alkanolamine oligomer having a structure such that at least one alkanolamine (a3) represented by the following general formula (1) is subjected to dehydration condensation, the alkanolamine oligomer having a degree of polymerization of no less than 2; and (ii) at least one second amide compound having a structure such that an amino group and at least one hydroxy group of the at least one alkanolamine (a3) represented by the following general formula (1) are acylated with the monovalent fatty acid (a1), the at least one second amide compound being an amide-esterification product, wherein a content of the component (ii) is no less than 8.0 mass % based on total content in terms of entire acylated compound obtained by acylating, with the monovalent fatty acid (a1), a compound having an alkanolamine structure where a hydroxy group may be etherified in a state of forming no salt:

$$[HO—R^1]_n NH_{3-n} \quad (1)$$

in the general formula (1), n is 1 or 2; $R^1$ is C1-4 linear chain alkylene or C3-10 branched chain alkylene having a main chain, the main chain having a carbon number of 2; and when n is 2, a plurality of $R^1$'s may be the same, and may be different from each other.

2. The lubricating oil additive composition according to claim 1, further comprising:

(iii) at least one third amide compound that is an amide of the alkanolamine (a3) and the monovalent fatty acid (a1), the at least one third amide compound having no ester bond.

3. The lubricating oil additive composition according to claim 2, further comprising:

(iv) at least one fourth amide compound, and/or a salt thereof, the at least one fourth amide compound having a structure such that at least one amino group and at least one hydroxy group of the amine compound (a2) are acylated with the monovalent fatty acid (a1).

4. The lubricating oil additive composition according to claim 1, wherein the monovalent fatty acid includes at least one straight chain fatty acid.

5. The lubricating oil additive composition according to claim 1, wherein the monovalent fatty acid includes at least one branched chain fatty acid.

6. The lubricating oil additive composition according to claim 5, wherein the branched chain fatty acid has a tertiary or quaternary carbon atom at an α, β or γ position of carbonyl carbon.

7. A lubricating oil composition comprising:

a lubricant base oil including at least one mineral base oil, at least one synthetic base oil, or combination thereof; and (A) the lubricating oil additive composition according to claim 1.

8. The lubricating oil composition according to claim 7, wherein a content of the (A) component is 0.005 to 10.0 mass % based on total mass of the lubricating oil composition in terms of entire acylated compound obtained by acylating, with the monovalent fatty acid (a1), a compound having an alkanolamine structure where a hydroxy group may be etherified in a state of forming no salt.

9. The lubricating oil composition according to claim 7, further comprising:

at least one additive selected from a metallic detergent, an ashless dispersant, a phosphorus-containing anti-wear agent, a sulfur-containing extreme-pressure agent, an antioxidant, and a viscosity index improver.

10. The lubricating oil composition according to claim 7, wherein a kinematic viscosity at 40° C. is 5.0 to 50 $mm^2/s$.

11. The lubricating oil composition according to claim 7, wherein the composition is used to lubricate gears.

12. The lubricating oil additive composition according to claim 1, further comprising:

(iv) at least one fourth amide compound, and/or a salt thereof, the at least one fourth amide compound having a structure such that at least one amino group and at least one hydroxy group of the amine compound (a2) are acylated with the monovalent fatty acid (a1), wherein a total content of the components (i) and (iv) is at most 14 mass % based on total mass of the composition.

13. The lubricating oil additive composition according to claim 12, wherein the at least one monovalent fatty acid (a1) constituting the components (i) and (iv) has a branched chain.

* * * * *